US008915751B2

(12) United States Patent
Wood

(10) Patent No.: US 8,915,751 B2
(45) Date of Patent: Dec. 23, 2014

(54) MALE COAXIAL CONNECTORS HAVING GROUND PLANE EXTENSIONS

(75) Inventor: Kenneth Steven Wood, Elmira, NY (US)

(73) Assignee: CommScope, Inc. of North Carolina, Hickory, NC (US)

( * ) Notice: Subject to any disclaimer, the term of this patent is extended or adjusted under 35 U.S.C. 154(b) by 296 days.

(21) Appl. No.: 13/482,002

(22) Filed: May 29, 2012

(65) Prior Publication Data

US 2013/0323967 A1 Dec. 5, 2013

(51) Int. Cl.
*H01R 9/05* (2006.01)

(52) U.S. Cl.
USPC ..... 439/578

(58) Field of Classification Search
USPC ..... 439/578
See application file for complete search history.

(56) References Cited

U.S. PATENT DOCUMENTS

| | | | | |
|---|---|---|---|---|
| 3,632,928 | A * | 1/1972 | Emmerich et al. | 218/123 |
| 5,653,605 | A | 8/1997 | Woehl et al. | |
| 5,702,263 | A | 12/1997 | Baumann et al. | |
| 6,152,753 | A | 11/2000 | Johnson et al. | |
| 6,358,077 | B1 | 3/2002 | Young | |
| 6,491,546 | B1 | 12/2002 | Perry | |
| 6,530,807 | B2 | 3/2003 | Rodrigues et al. | |
| 6,712,631 | B1 | 3/2004 | Youtsey | |
| 6,716,062 | B1 | 4/2004 | Palinkas et al. | |
| 6,817,896 | B2 | 11/2004 | Derenthal | |
| 6,872,907 | B2 * | 3/2005 | Claessens et al. | 218/66 |
| 7,041,928 | B2 * | 5/2006 | Nowakowski | 218/59 |
| 7,097,499 | B1 * | 8/2006 | Purdy | 439/578 |
| 7,425,153 | B1 * | 9/2008 | Miller | 439/578 |
| 7,566,236 | B2 | 7/2009 | Malloy et al. | |
| 7,766,662 | B2 * | 8/2010 | Akama et al. | 439/63 |
| 7,802,993 | B2 * | 9/2010 | Akama et al. | 439/63 |
| 7,892,024 | B1 | 2/2011 | Chen | |
| 7,938,680 | B1 | 5/2011 | Hsieh | |
| 7,955,126 | B2 * | 6/2011 | Bence et al. | 439/583 |
| 8,246,392 | B2 * | 8/2012 | Amidon | 439/851 |
| 8,517,763 | B2 * | 8/2013 | Burris et al. | 439/578 |
| 8,690,603 | B2 * | 4/2014 | Bence et al. | 439/583 |
| 2002/0164900 | A1 * | 11/2002 | Youtsey | 439/578 |
| 2003/0181099 | A1 * | 9/2003 | D'Addario | 439/578 |
| 2009/0098770 | A1 * | 4/2009 | Bence et al. | 439/583 |
| 2011/0117776 | A1 | 5/2011 | Burris et al. | |
| 2013/0072059 | A1 * | 3/2013 | Purdy et al. | 439/583 |

* cited by examiner

*Primary Examiner* — Truc Nguyen
(74) *Attorney, Agent, or Firm* — Myers Bigel Sibley & Sajovec, P.A.

(57) ABSTRACT

Coaxial connectors are provided that include a contact post that has a pedestal and a post extending therefrom. These connectors further include a ground plane extension that is separate from the contact post. The ground plane extension includes a first end that is positioned on a first side of the pedestal and a sidewall that extends from the first end of the ground plane extension. This sidewall extends beyond a second side of the pedestal that is opposite the first side.

24 Claims, 18 Drawing Sheets

MALE COAXIAL CONNECTORS HAVING GROUND PLANE EXTENSIONS

FIELD OF THE INVENTION

The present invention relates to connectors for coaxial cables and, more particularly, to coaxial connectors that may maintain a reliable ground plane connection.

BACKGROUND

A coaxial cable is a known type of electrical cable that may be used to carry radio frequency ("RF") signals. Coaxial cables are widely used as transmission lines in cable television networks and/or to provide broadband Internet connectivity. FIG. 1 is a perspective view of a conventional coaxial cable 10 that has been partially cut apart to reveal its internal structure. As shown in FIG. 1, the coaxial cable 10 has a central conductor 12 that is surrounded by a dielectric insulator 14. A tape 16 may be bonded to the outside surface of the dielectric insulator 14. A metallic electrical shield 18, which typically comprises braided shielding wires and, optionally, one or more electrical shielding tapes (not shown in FIG. 1), surrounds the central conductor 12, dielectric insulator 14 and tape 16. Finally, a cable jacket 20 surrounds the electrical shield 18.

A coaxial cable such as cable 10 has two conductors, namely the central conductor 12 and the electrical shield 18. Current travels outward from the source on one of the conductors 12, 18 and returns on the other conductor 12, 18. However, as coaxial cables such as cable 10 are typically used to carry alternating currents, it will be appreciated that the current flow reverses direction on the conductors 12, 18 many times per second. Typically, a conductor that carries high frequency signals such as RF signals acts as an antenna, and thus some of the signal energy is radiated from the conductor, resulting in signal loss or "attenuation." Coaxial cables, however, are designed to minimize such signal attenuation by positioning the first conductor (central conductor 12) inside the second conductor (electrical shield 18), and by connecting the second conductor 18 to a reference voltage such as an electrical ground reference. As a result of this arrangement, the electromagnetic field of the signal carried by the central conductor 12 is generally trapped in the space inside the electrical shield 18, thereby greatly reducing signal leakage and associated signal attenuation losses.

Typically, each end of a coaxial cable is terminated with a male coaxial connector that may be used to connect the coaxial cable to a female coaxial connector port. The most common type of male and female coaxial connectors are known in the art as "F-style" coaxial connectors. A conventional male F-style coaxial connector is depicted in FIGS. 2-4, and a conventional female F-style coaxial connector port is depicted in FIG. 5. Both of these connectors are described in detail below. Female F-style connector ports are commonly mounted on wall plates in homes and on various devices such as televisions, cable modems, etc. As shown in FIG. 5, a typical female F-style connector port comprises an externally threaded cylindrical housing that includes an aperture on one end thereof that is configured to receive a protruding central conductor of a male F-style coaxial connector. As shown in FIGS. 2-4, a typical male F-style coaxial connector includes an internally-threaded nut which is threaded onto the externally-threaded housing of the female F-style coaxial connector port. A coaxial cable that includes a male coaxial connector on at least one end thereof is referred to herein as a "patch cord." Jumper cables that are commonly used, for example, to connect a device such as a cable television or a cable modem to a wall outlet are one well known type of patch cord.

FIG. 2 is a perspective view of a conventional male F-style coaxial connector 30. FIG. 3 is a side cross-sectional view of the male F-style coaxial connector 30 of FIG. 2. FIG. 4 illustrates the connector 30 of FIGS. 2-3 after it has been attached to an end of a coaxial cable 10.

As shown in FIGS. 2-4, the connector 30 includes a tubular connector body 32, a compression sleeve 34, a contact post 36 and an internally-threaded nut 38. The contact post 36 includes a pedestal 36' and a post extending therefrom. In FIG. 2, the compression sleeve 34 is depicted in its "unseated" position in which it may receive a cable that is to be terminated into the connector 30.

When the compression sleeve of connector 30 is in the unseated position, a coaxial cable such as cable 10 may be inserted axially into the compression sleeve 34 and the tubular connector body 32. In particular, the central conductor 12, dielectric insulator 14 and tape 16 (coaxial cable 10 is not depicted in FIGS. 2-3 to more clearly show the structure of the connector 30) are inserted axially into the inside diameter of the contact post 36, while the electrical shield 18, and the cable jacket 24 are inserted so as to circumferentially surround the outer surface of the contact post 36. The outside surface of the contact post 36 may include one or more serrations, teeth, lips or other retention structures 37 (see FIG. 3). Once the cable 10 is inserted into the connector 30 as described above, a compression tool may be used to forcibly axially insert the compression sleeve 34 further into the tubular connector body 32 into its "seated" position (see FIG. 4). The compression sleeve 34 directly decreases the radial gap spacing between the connector body 32 and the contact post 36 so as to radially impart a generally 360-degree circumferential compression force on the electrical shield 18 and the cable jacket 20 that circumferentially surround the outer surface of contact post 36. This compression, in conjunction with the retention structures 37 on the outside surface of the contact post 36, applies a retention force to the coaxial cable 10 that firmly holds the coaxial cable 10 within the connector 30. As shown in FIG. 4, the central conductor 12 of the coaxial cable 10 extends into the internal cavity of the nut 38 to serve as the male protrusion of the connector 30.

As noted above, male F-style coaxial connectors are used to mechanically and electrically attach a coaxial cable such as cable 10 to a female connector port such as, for example, a standard coaxial cable wall outlet or a port on an electronic device such as a cable-ready television set. FIG. 5 is a perspective view of a conventional F-style female connector port 40. As shown in FIG. 5, the female connector port 40 may comprise a cylindrical housing 41 that has a plurality of external threads 42. The distal face 44 of the cylindrical housing 41 includes an aperture 46. A central conductor 48 (barely visible in FIG. 5) runs longitudinally through the center of the female connector port 40. This central conductor 48 is configured to receive the central conductor 12 of a mating male F-style coaxial connector 30. The rotatable nut 38 of a mating male coaxial connector 30 is inserted over, and threaded onto, the female connector port 40 so that the central conductor 12 of the coaxial cable 10 that is attached to the connector 30 is received within the aperture 46, thereby mechanically and electrically connecting coaxial cable 10 to the female connector port 40.

SUMMARY

Pursuant to embodiments of the present invention, coaxial connectors are provided that include a contact post that has a pedestal and a post extending therefrom. These connectors further include a ground plane extension that is separate from the contact post. The ground plane extension includes a first end that is positioned on a first side of the pedestal and a sidewall that extends from the first end of the ground plane extension. This sidewall extends beyond a second side of the pedestal that is opposite the first side.

In some embodiments, the first end comprises an attachment ring and a second end of the ground plane extension that is opposite the first end may comprise one or more sidewalls that define a generally cylindrical sidewall. The generally cylindrical sidewall may include an inwardly extending region. In some embodiments, the generally cylindrical sidewall may include at least one longitudinal slit. The attachment ring and the sidewall may be formed of a resilient conductive material. The attachment ring may define an aperture that is configured to receive the post of the contact post. These coaxial connectors may also include a connector body having an internal cavity and an internally-threaded nut that includes a female connector port receiving cavity, the internally-threaded nut attached to at least one of the connector body and the contact post. The contact post may be at least partly within the internal cavity of the connector body.

In some embodiments, at least a portion of the generally cylindrical sidewall may be configured to fit directly between a housing of a female connector port and an internal diameter of the female connector port receiving cavity of the internally-threaded nut when the female connector port is received within the female connector port receiving cavity of the internally-threaded nut. Moreover, the internally-threaded nut may be formed of an insulative material. In some embodiments, the attachment ring may comprise a spring member that is positioned between the pedestal of the contact post and an internal annular ridge of the internally-threaded nut. A portion of the female connector port receiving cavity of the internally-threaded nut that is adjacent to the pedestal of the contact post may not include any threads.

Pursuant to further embodiments of the present invention, coaxial connectors are provided that include a connector body, a contact post that includes a pedestal and a post extending from the pedestal, and an internally-threaded nut that includes a female connector port receiving cavity. The internally-threaded nut may be attached to at least one of the connector body and the contact post, and may be formed of an insulative material. These connectors further include a ground plane extension that is electrically connected to the contact post, the ground plane extension being positioned at least partly within the female connector port receiving cavity of the internally-threaded nut.

In some embodiments, the conductive ground plane extension comprises a conductive element having an attachment ring and at least one sidewall. The attachment ring may include an aperture that receives the post of the contact post and the sidewall may extend into the female connector port receiving cavity of the internally-threaded nut. At least part of the ground plane extension may be formed of a resilient metal.

Pursuant to still further embodiments of the present invention, coaxial connectors are provided that include a connector body, a contact post that includes a pedestal and a post extending from the pedestal, the contact post being positioned at least partly within the connector body, an internally-threaded nut that includes a female connector port receiving cavity, the internally-threaded nut attached to at least one of the connector body and the contact post, and a ground plane extension that is electrically connected to the contact post. The ground plane extension includes a first spring that is configured to contact a female connector port that is received within the female connector port receiving cavity of the internally-threaded nut and a second spring that is configured to contact a side of the pedestal that receives the post.

In some embodiments, the ground plane extension may include a sidewall that has an inwardly extending region that forms at least part of the first spring. Moreover, a portion of the female connector port receiving cavity of the internally-threaded nut that is adjacent to the pedestal of the contact post may be devoid of threads.

The coaxial connectors according to embodiments of the present invention may be mounted on coaxial cables to provide coaxial patch cords.

DETAILED DESCRIPTION

Figure 1:
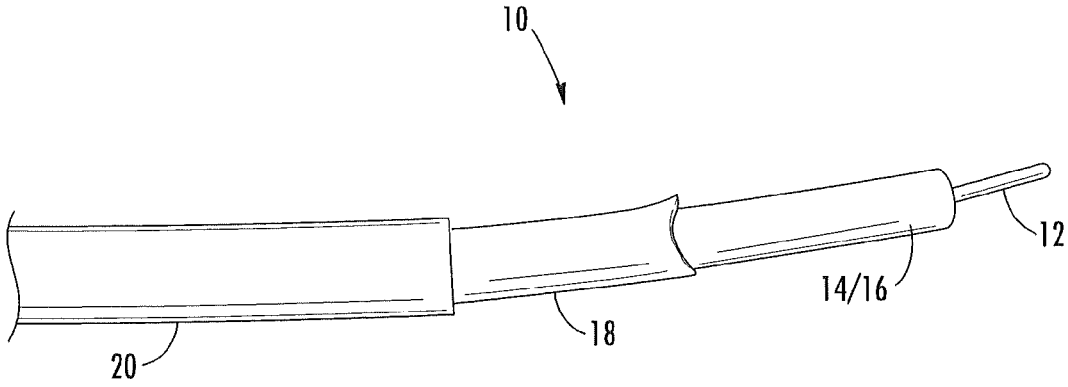
FIG. 1 (PRIOR ART)
FIG. 1 is a perspective view of a conventional coaxial cable that has been partially cut apart.

The present invention now is described more fully hereinafter with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the size and/or relative positions of lines and elements may be exaggerated for clarity. It will also be understood that when an element is referred to as being "coupled," "connected," or "attached" to another element, it can be coupled, connected or attached directly to the other element, or intervening elements may also be present. In contrast, when an element is referred to as being "directly coupled" "directly connected," or "directly attached" to another element, there are no intervening elements present.

Unless otherwise defined, all technical and scientific terms used herein have the same meaning as commonly understood by one of ordinary skill in the art to which this invention belongs. The terminology used in the description herein is for the purpose of describing particular embodiments only and is not intended to be limiting of the invention. As used in the description and the appended claims, the singular forms "a", "an" and "the" are intended to include the plural forms as well, unless the context clearly indicates otherwise. As used herein, the term "and/or" includes any and all combinations of one or more of the associated listed items.

This invention is directed, in part, to coaxial connectors. As used herein, the term "longitudinal" and derivatives thereof refer to the direction defined by the central axis of the coaxial connector, which is generally coexistent with the central axis of any coaxial cable that the coaxial connector is installed on when the coaxial cable is fully extended in a straight line. Herein, the terms "front", "front end" and derivatives thereof when used with respect to a male coaxial connector refer to the end of the male coaxial connector that mates with a female connector port. Thus, the "front" or "front end" of a male coaxial connector refers to the end of the connector that includes a protruding center conductor that is inserted into a mating female connector port. Likewise, references herein to the "rear" or "rear end" of a male coaxial connector refer to the end of the coaxial connector that is opposite the front end (i.e., the end of the male coaxial connector that receives the coaxial cable).

Figure 6:
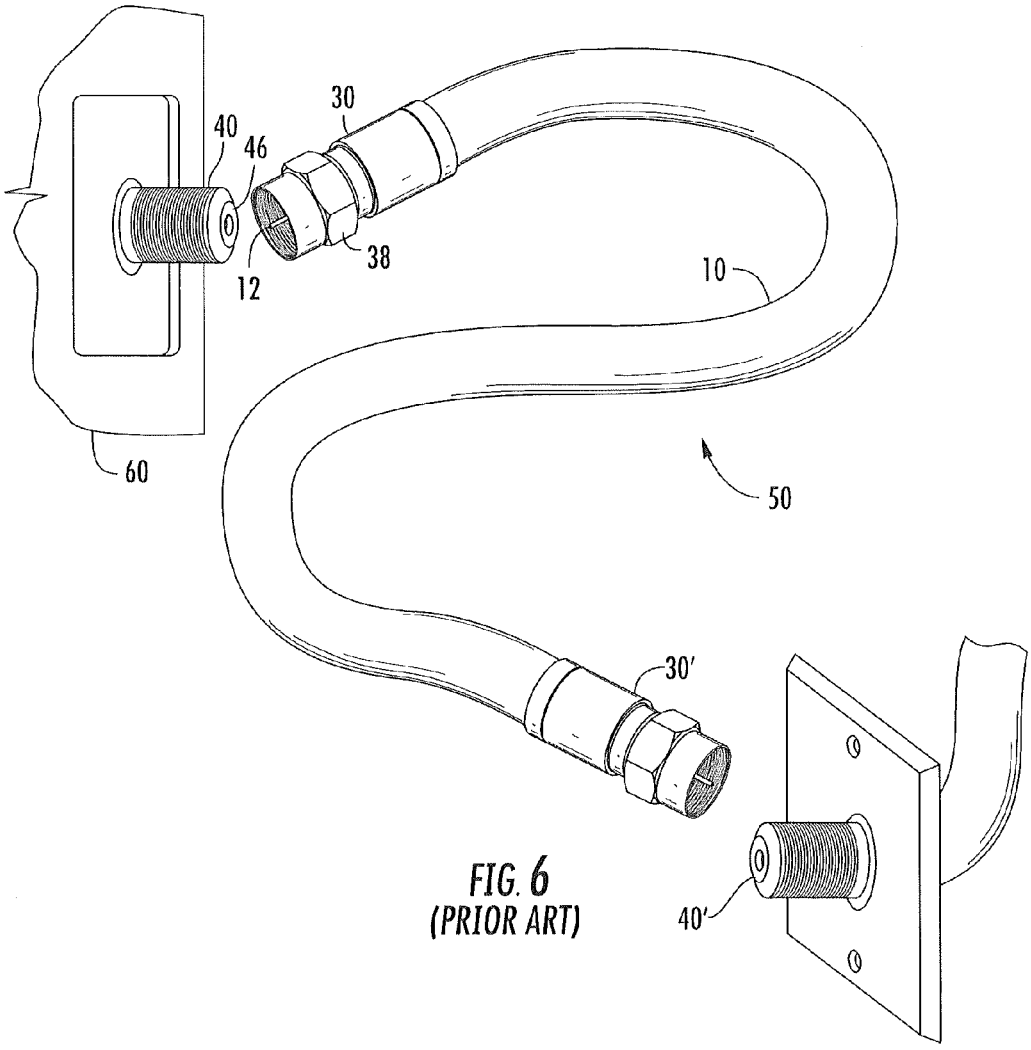
FIG. 6 (PRIOR ART)
FIG. 6 is a schematic diagram illustrating how a coaxial patch cord may be used to electrically connect a device to a wall outlet.

As noted above, coaxial patch cords are commonly used in homes and other premises to connect televisions, cable modems and other end devices to wall-mounted female connector ports. Coaxial patch cords are also routinely used to connect network equipment in outdoor "cable boxes" and other enclosures to input ports in individual homes, apartment buildings and the like. FIG. 6 illustrates how a coaxial patch cord 50 may be used to connect a first female connector port 40 that is provided on an end device 60 to a second female connector port 40' that is mounted on a wall outlet. The coaxial patch cord 50 comprises a coaxial cable 10 that has male F-style coaxial connectors 30 and 30' mounted on the respective ends thereof.

Figure 3:
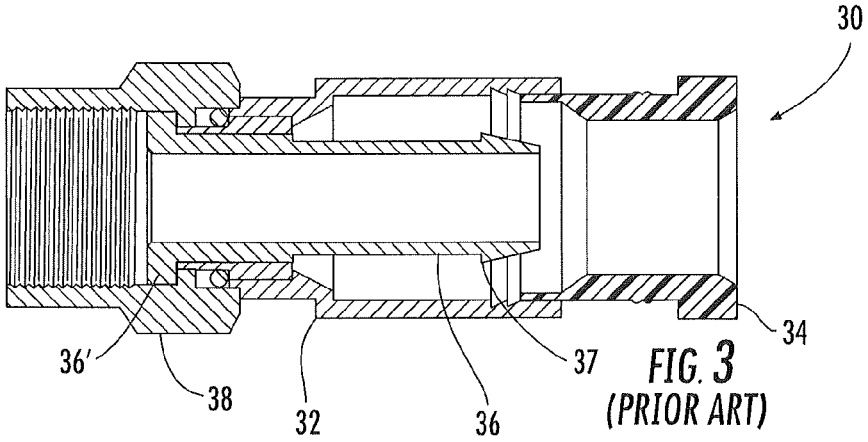
FIG. 3 (PRIOR ART)
FIG. 3 is a side cross-sectional view of the conventional F-style coaxial connector of FIG. 2.
Figure 5:
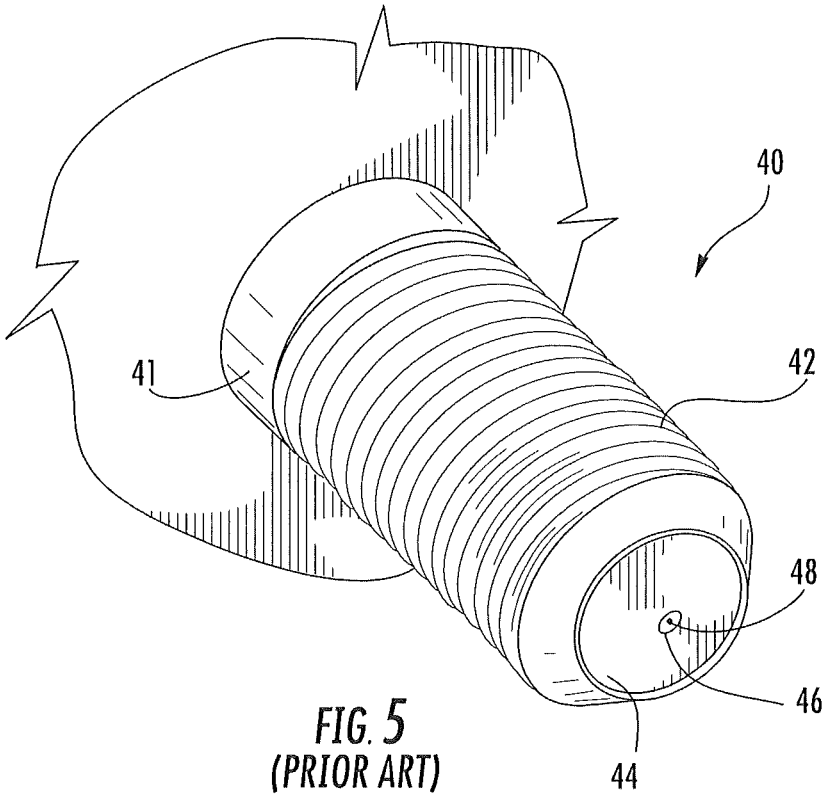
FIG. 5 (PRIOR ART)
FIG. 5 is a perspective view of a conventional female connector port.

When, for example, the connector 30 is mounted on the female connector port 40, the center conductor 12 of connector 30 is received within the prongs of the central conductor 48 (see FIG. 5) of connector port 40, thereby establishing an electrical connection between center conductor 12 of connector 30 and female connector port 40. Likewise, once the internally-threaded nut 38 of connector 30 is firmly tightened onto the female connector port 40, the distal face 46 of the female connector port 40 comes into both mechanical and electrical contact with the front face of the pedestal 36' of the contact post 36 (see FIG. 3). As the electrical shield 18 of the coaxial cable 10 directly contacts the back side of the pedestal 36' of the contact post 36, and as the contact post 36 is made of a conductive material, a first or "primary" electrical connection is provided between the electrical shield 18 and the conductive housing 41 of the female connector port 40 via contact post 36. This electrical connection between the coaxial cable 10 and the female connector port 40 is used to carry the ground reference (herein "the primary ground plane conduction path"). A secondary, indirect ground plane conduction path may also be provided from the contact post 36 to the housing 41 through the threaded connection between nut 38 and housing 41, as the contact post 36 is in electrical contact with nut 38 either directly and/or through the connector body 32.

Vibrations, thermal cycling, rotational forces and/or other forces (e.g., forces applied as the result of the movement of an end device) may be applied to the coaxial patch cord 50 during normal operation that can loosen the connection between one or both of the coaxial connectors 30, 30' and the female connector ports 40, 40' with which they are mated. By way of example, if the end device 60 in FIG. 6 comprises a television 60 that is mounted on a swiveled base, the swivel movements that will be applied to the television during normal use can, over time, cause the internally-threaded nut 38 on the coaxial connector 30 to start unthreading or "loosening" from the female connector port 40. Unfortunately, when this occurs, the ground plane conduction path can be degraded or lost for at least several reasons.

First, as the internally-threaded nut 38 unthreads, the above described primary ground plane conduction path between the front face of the pedestal 36' of the contact post 36 and the front face 44 of housing 41 of female connector port 40 may be degraded or lost because the front face 44 separates from the pedestal 36' of the contact post 36, thereby breaking the primary ground plane conduction path from the contact post 36 to the housing 41. Second, as the nut 38 loosens, the electrical connection through the threads of nut 38 and the threads 42 of female connector port 40 may also be degraded, as the threads are no longer firmly pressed against each other providing a strong contact force. This degradation may cause loss of the secondary ground plane conduction path. Third, as the nut 38 loosens, the connection between the nut 38 and the connector body 32 also may become less reliable, as once loosened, the nut 38 is generally designed to rotate freely about the connector body 32, and hence the mechanical and electrical connection between the connector body 32 and the internally-threaded nut 38 may be degraded and/or even lost once the nut 38 is no longer firmly tightened onto the female connector port 40. This degradation may also cause loss of the secondary ground plane conduction path. Thus, as the nut 38 becomes unthreaded from female connector port 40, both the primary and secondary ground plane conduction paths may be degraded or lost, with a corresponding degradation or loss of the RF signal. Even a relatively small amount of loosening of the internally-threaded nut 38 can result in degradation or loss of one or both ground plane conduction paths.

Pursuant to embodiments of the present invention, coaxial connectors (and patch cords that include such coaxial connectors) are provided which include ground plane extensions that may maintain a good electrical connection between the electrical shield 18 of a coaxial cable such as cable 10 and the conductive housing 41 of a female connector port 40, even when the internally-threaded nut of the connector is not fully threaded onto the female connector port 40. In fact, the coaxial connectors according to embodiments of the present invention may become unloosened from a female connector port by as much as, for example, three full turns (or possibly more) and should still maintain a reliable ground plane connection between the male coaxial connector and the female connector port 40 on which it is mounted. Moreover, the ground plane extensions according to embodiments of the present invention may also increase the drag and mechanical resistance of the threaded connection between the internally-threaded nut of the connector and the female connector port 40. Thus, the coaxial connectors according to some embodiments of the present invention may be resistant to loosening during normal use, and may maintain good electrical performance even when some loosening occurs.

Figure 7:
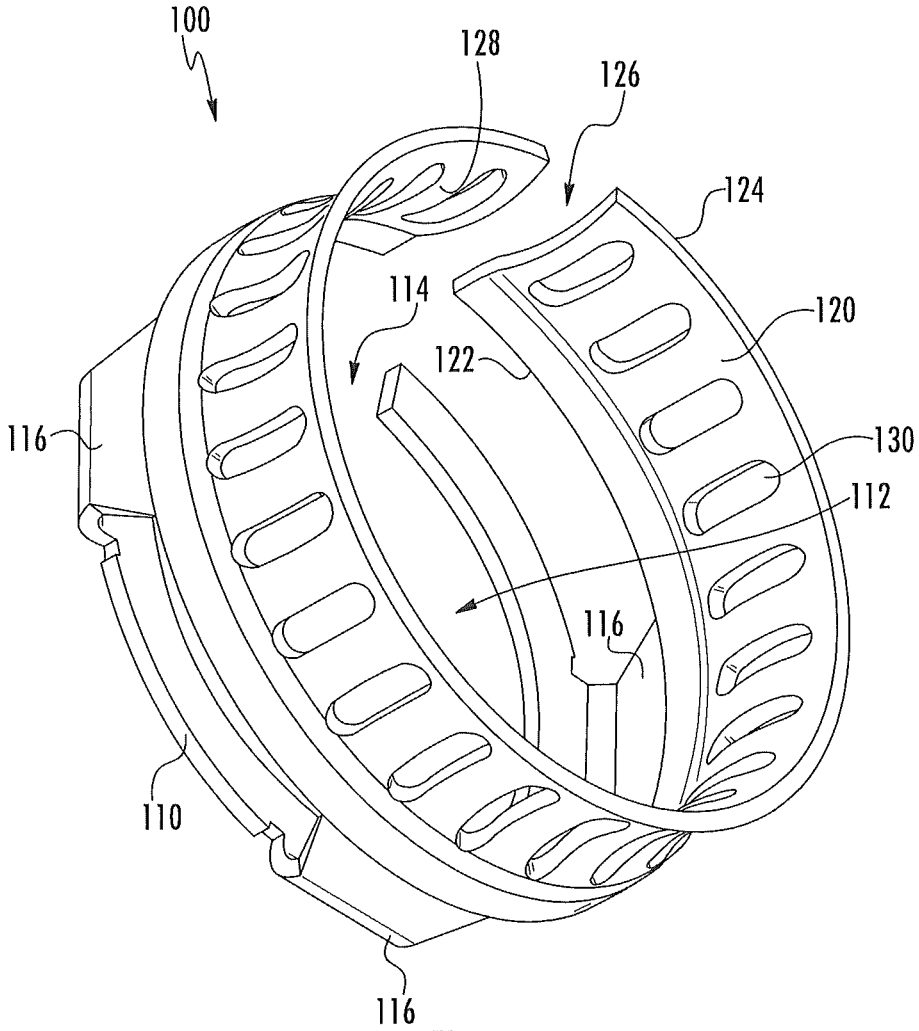
FIG. 7 is a perspective view of a ground plane extension according to certain embodiments of the present invention.

FIG. 7 is a perspective view of a ground plane extension 100 according to certain embodiments of the present invention. As will be explained below, the ground plane extension 100 (and the other ground plane extensions disclosed herein) may be included in coaxial connectors according to embodiments of the present invention to provide "continuity" coaxial connectors that exhibit a good electrical connection for the ground plane and/or that may resist loosening from a female connector port.

As shown in FIG. 7, the ground plane extension 100 includes an attachment ring 110 that may be used to mount the ground plane extension 100 onto the contact post of a male coaxial connector. In the depicted embodiment, the attachment ring does not quite complete a full circle, and hence a gap 114 is defined between the two ends of the attachment ring 110. In other embodiments, the attachment ring 110 may form a complete circle or, alternatively, may be replaced with a plurality of spaced-apart tabs. The attachment ring 110 defines an aperture 112 that may be sized to receive, for example, the post of the contact post of the coaxial connector in which the ground plane extension 100 is used.

The ground plane extension 100 further includes a generally cylindrical sidewall 120. The sidewall 120 includes a base 122 and a distal portion 124. Like the attachment ring 110, the sidewall 120 does not quite complete a full circle, and hence a gap 126 is defined between the two ends of the generally cylindrical sidewall 120. The distal portion 124 of the sidewall 120 may have a concave profile (when viewed from outside the ground plane extension 100) so that the distal portion 124 includes an inwardly extending region 128. This inwardly extending region 128 may be configured to make mechanical and electrical contact with the cylindrical housing 41 of a female connector port 40 when the ground plane extension 100 is used in a male coaxial connector that is mounted on the female connector port 40. The distal portion 124 of sidewall 120 may include a plurality of apertures 130. In the embodiment illustrated in FIG. 7, the apertures 130 comprise longitudinally extending rectangular apertures that have rounded corners. The apertures 130 may increase the resiliency of the ground plane extension 100 which, as discussed below, may be used to provide an improved mechanical and electrical contact between the ground plane extension 100 and a female connector port 40. It will be appreciated that the shape and/or number of apertures 130 included in the distal portion 124 of the sidewall 120 may be varied from that which is shown in FIG. 7 and that, in some embodiments, the apertures 130 may be omitted.

A plurality of connection tabs 116 connect the base 122 of sidewall 120 to the attachment ring 110. In the depicted embodiment, a total of three connection tabs 116 are provided. In other embodiments, more or less than three connection tabs 116 may be provided. In some embodiments, a single connection tab 116 may be provided that, for example, extends continuously all the way or most of the way around the outside edge of the attachment ring 110.

The ground plane extension 100 may be formed of a conductive material such as a metal. For example, the ground plane extension 100 may be formed of brass or bronze in some embodiments. The attachment ring 110 and/or the sidewall 120 may be very thin. In some embodiments, the attachment ring 110 and/or sidewall 120 of the ground plane extension 100 may be formed of a resilient metal such as, for example, phosphor-bronze or beryllium-copper.

Figure 8:
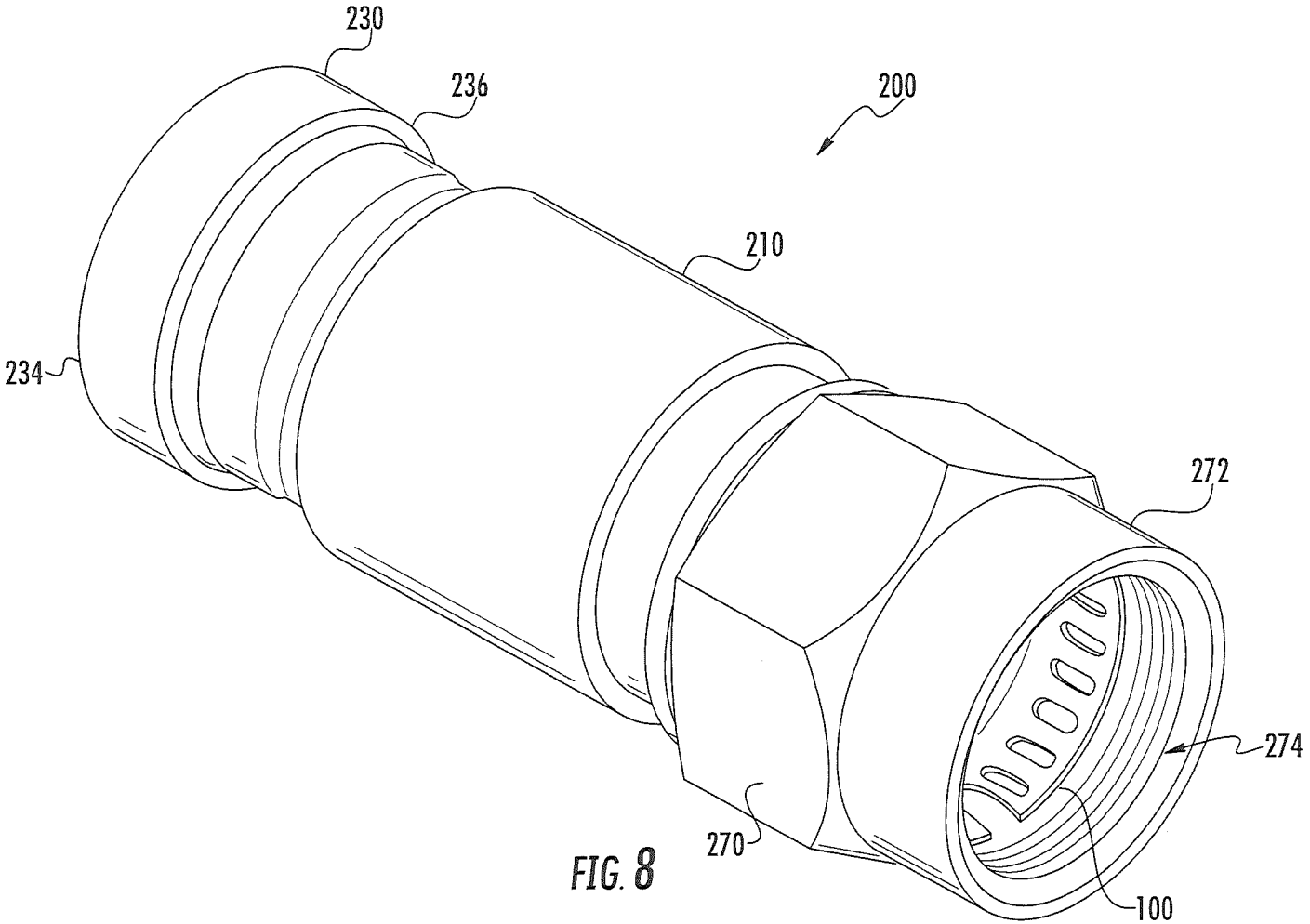
FIG. 8 is a perspective view of a coaxial connector according to embodiments of the present invention that includes the ground plane extension of FIG. 7.
Figure 9:
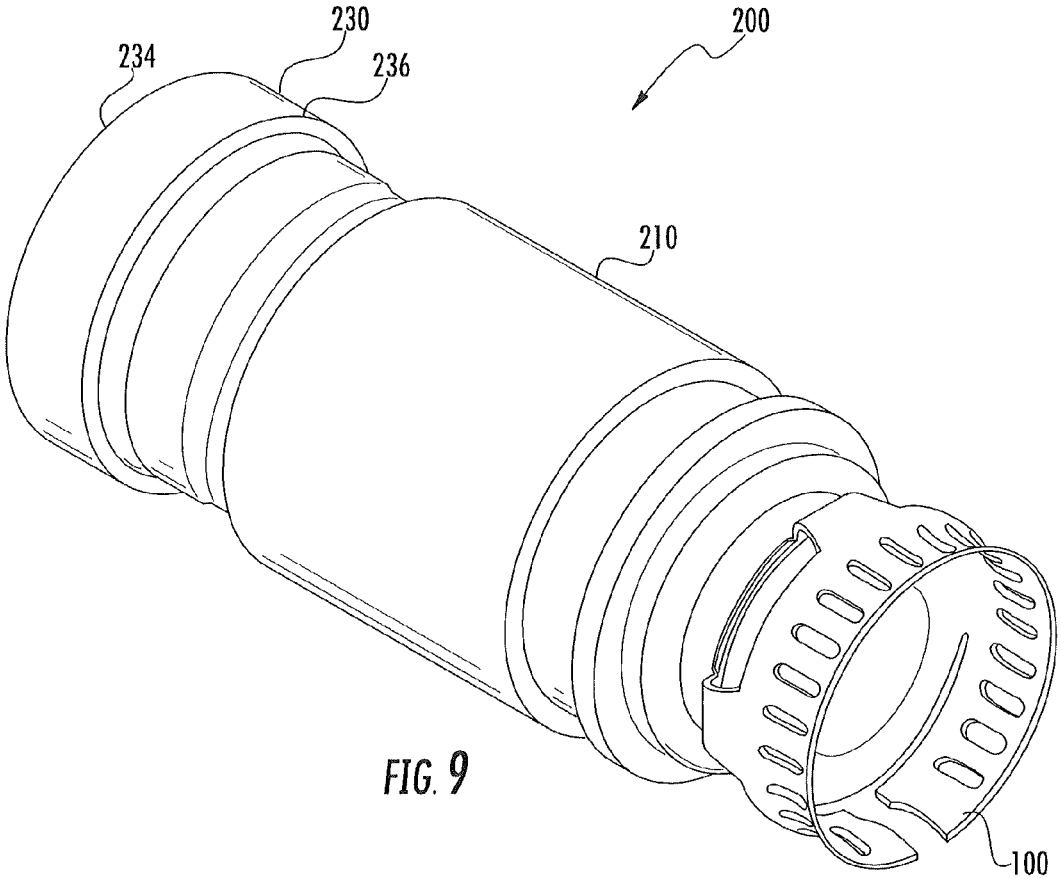
FIG. 9 is a perspective view of the coaxial connector of FIG. 8 with the internally-threaded rotatable nut thereof omitted to illustrate how the ground plane extension mounts on the contact post.
Figure 10:
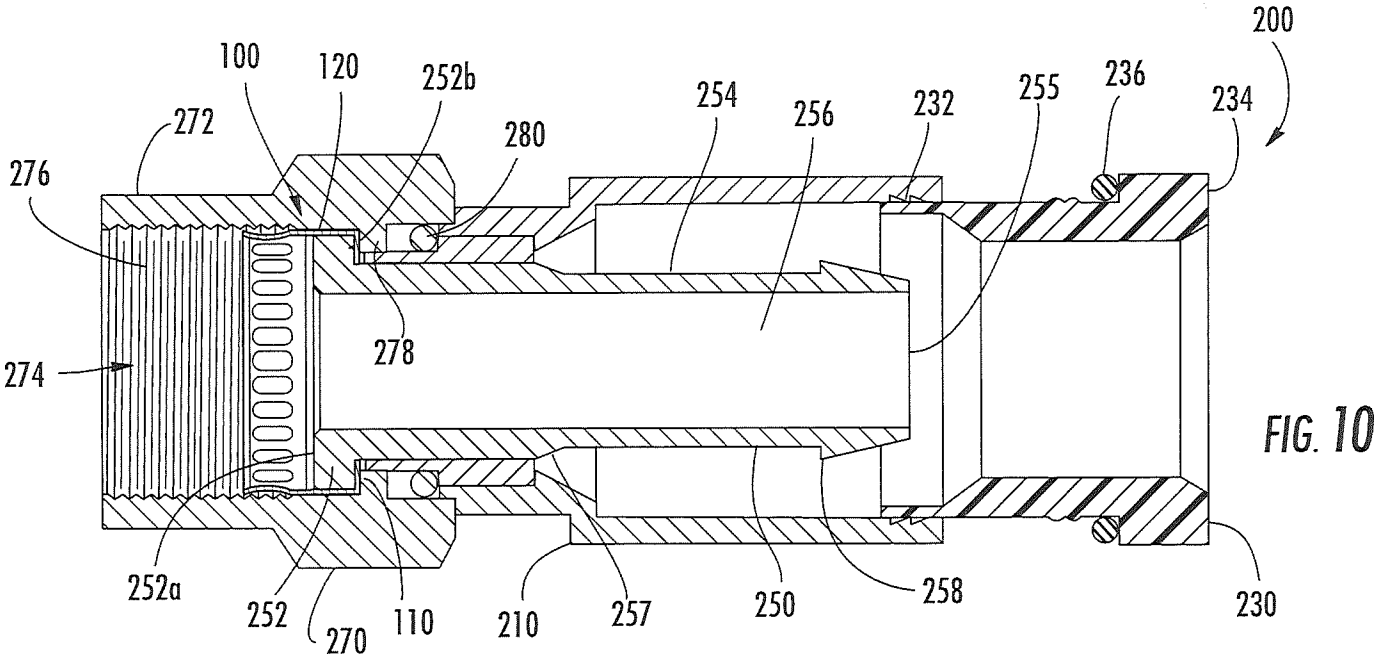
FIG. 10 is a cross-sectional view of the coaxial connector of FIG. 8.
Figure 11:
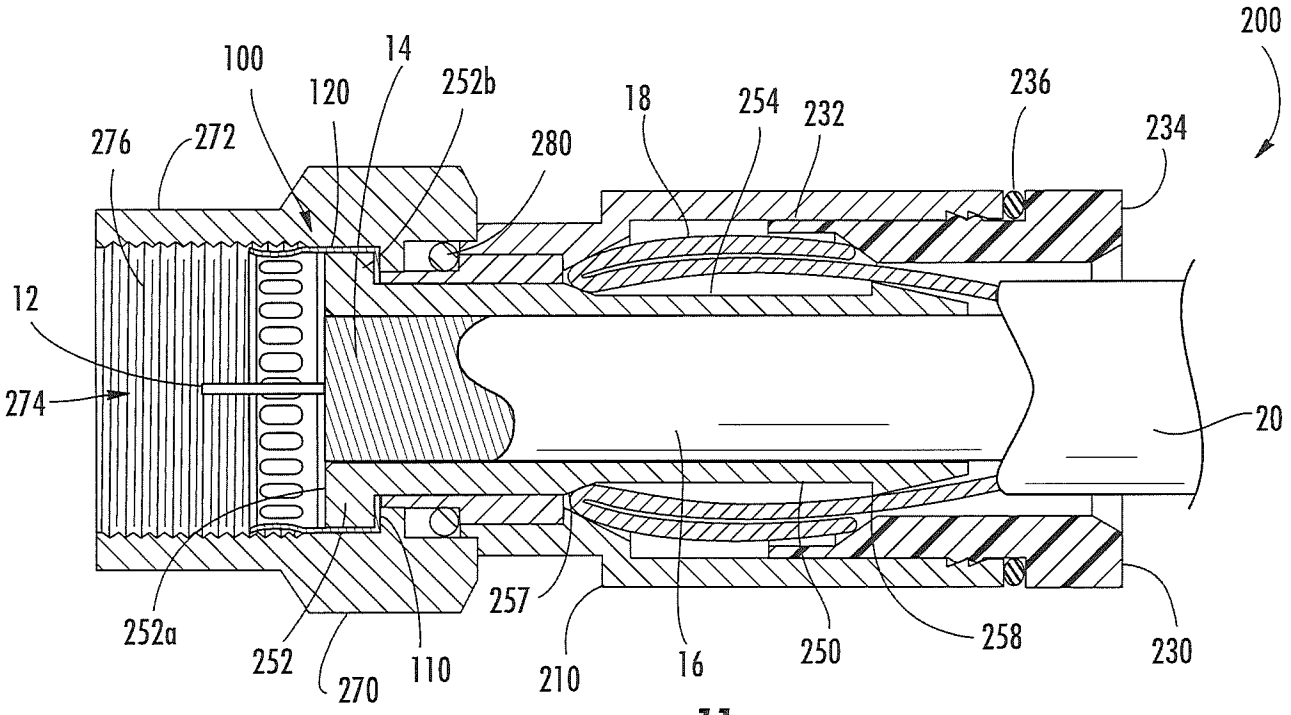
FIG. 11 is a cross-sectional view of the coaxial connector of FIG. 8 after it has been terminated onto a coaxial cable.
Figure 12:
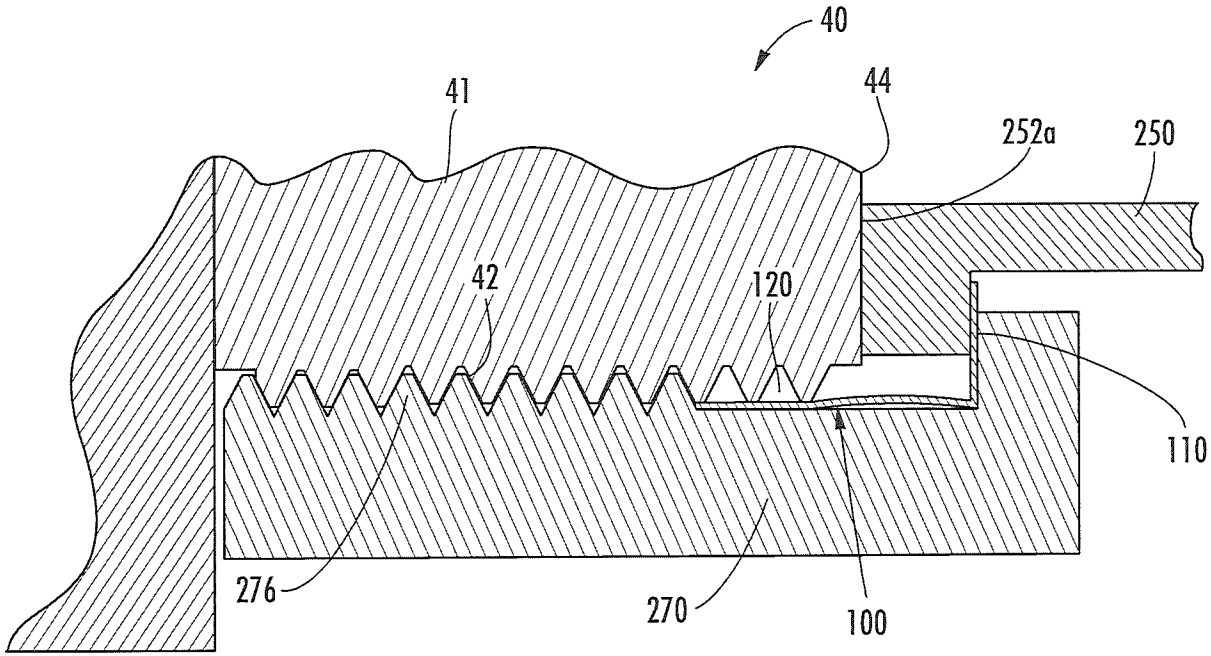
FIG. 12 is a cross-sectional view of a portion of the connector of FIG. 8 after the connector has been firmly threaded onto a female connector port.
Figure 13:
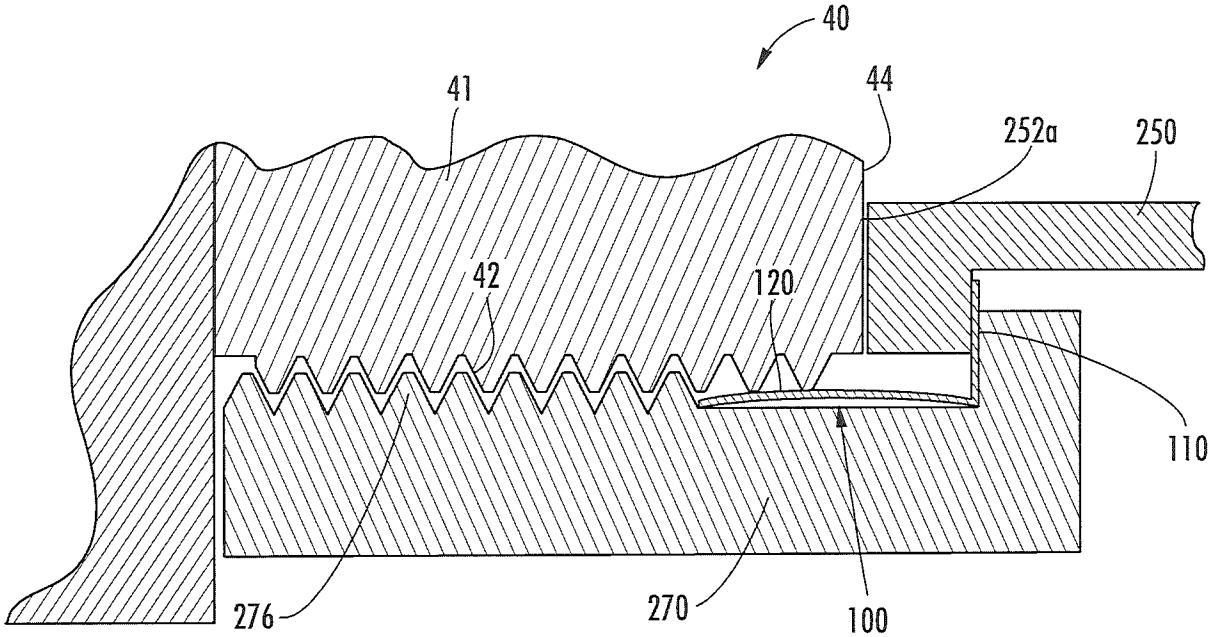
FIG. 13 is a cross-sectional view of a portion of the connector of FIG. 8 threaded onto a female connector port after the threaded connection has loosened to a degree.

FIGS. 8-13 illustrate a coaxial connector 200 according to embodiments of the present invention that includes the ground plane extension 100 of FIG. 7. In particular, FIG. 8 is a perspective view of the coaxial connector 200. FIG. 9 is a perspective view of the coaxial connector 200 with its internally-threaded rotatable nut omitted to illustrate how the ground plane extension 100 mounts on the contact post. FIG. 10 is a cross-sectional view of the coaxial connector 200 of FIG. 8 with the compression sleeve thereof in its unseated position. FIG. 11 is a cross-sectional view of the coaxial connector 200 of FIG. 8 after it has been terminated onto a coaxial cable 10. FIG. 12 is a cross-sectional view of a portion of the connector 200 after it has been firmly threaded onto a mating female connector port 40. FIG. 13 is a cross-sectional view of a portion of the connector 200 mounted on the female connector port 40 after it has loosened to a degree from the female connector port 40.

Referring to FIGS. 8-13, it can be seen that the male F-style coaxial connector 200 includes a tubular connector body 210, a compression sleeve 230, a contact post 250 and an internally-threaded rotatable nut 270. The ground plane extension 100 may be used in any of a wide variety of conventional male F-style coaxial connectors, as well as in certain other types of coaxial connectors. Thus, it will be appreciated that the specific designs for the connector body 210, the compression sleeve 230, the contact post 250 and the internally-threaded rotatable nut 270 that are depicted in FIGS. 8-12 are not intended to be limiting, but are simply provided so that the present specification will provide a clear description as to how the ground plane extensions according to embodiments of the present invention may be included in coaxial connectors in order to improve the performance of the coaxial connectors.

As shown, for example, in FIGS. 9 and 10, the connector body 210 may comprise a generally cylindrical body piece having an open interior. The connector body 210 may be formed of a conductive metal such as, for example, brass, steel or bronze or alloys thereof or another metal or metal alloy. As shown in FIGS. 9 and 10, the inner and/or outer diameters of the cylindrical body piece of the connector body 210 may vary along the length of the connector body 210.

As shown in FIGS. 8 and 10, the internally-threaded nut 270 may comprise, for example, a brass or steel nut having an exterior surface that has a hexagonal cross-section in a direction normal to the longitudinal direction. It will be appreciated that the nut 270 may have other shaped cross-sections.

For example, a portion of the exterior surface of nut 270 may be textured or knurled to provide a better griping surface for finger tightening of the nut 270. Additionally, as discussed below, in some embodiments the nut 270 may alternatively be formed of an insulative material such as plastic. The internally-threaded nut 270 may include a lip 272. The internally-threaded nut 270 is mounted adjacent a front end of the connector body 210, and may be mounted so that the internally-threaded nut 270 may freely rotate with respect to the connector body 210. The internally-threaded nut 270 includes a female connector port receiving cavity 274 that includes a plurality of threads 276 in a front portion thereof. The female connector port receiving cavity 274 receives the female connector port 40 when the connector 200 is threaded onto the female connector port 40. The nut 270 further includes an internal annular ridge 278. An O-ring, gasket or other member 280 may be positioned between the internally-threaded nut 270 and the connector body 210 to reduce or prevent water or moisture ingress into the interior of the F-style connector 200.

As shown in FIGS. 10-11, the contact post 250 is mounted within both the connector body 210 and the internally-threaded nut 270. The contact post 250 includes a pedestal 252 that has a front face 252*a* and a rear face 252*b*. The contact post 250 further includes a post 254 that extends from the rear face 252*b* of the pedestal 252. The distal end of the post 254 includes an opening 255 that provides access to a cylindrical inner cavity 256 of the contact post 250. As shown in FIGS. 10-11, the contact post 250 may be used to connect the internally-threaded nut 270 to the connector body 210, and may facilitate mounting the internally-threaded nut 270 to the connector body 210 so that the internally-threaded nut 270 may be freely rotated independent of the connector body 210. The outside surface of the distal end of the post 254 may include one or more serrations, teeth, lips or other structures 258. The contact post 250 is formed of a conductive material such as, for example, brass or steel.

The compression sleeve 230 may comprise a hollow cylindrical body having a front end 232 and a rear end 234. The compression sleeve 230 is typically formed of a plastic material, but may also be formed of other materials such as brass, rubber or the like. In some embodiments, the front end 232 of the compression sleeve 230 may have a first external diameter that is less than a second external diameter of the rear end 234 of the compression sleeve 230. A gasket or O-ring 236 may be mounted on the exterior surface of the compression sleeve 230. As shown in FIGS. 10-11, the inner diameter of the front end 232 of the compression sleeve 230 may be greater than the inner diameter of the rear end 234 of the compression sleeve 230. A ramped transition section may connect the inner radii of the front end 232 and rear end 234 of the compression sleeve 230.

One of the connector body 210 or the compression sleeve 230 may include grooves or recesses (not shown) and the other of the connector body 210 or the compression sleeve 230 may include annular rings, detents or other raised surfaces (not shown) that mate with the grooves or recesses in order to hold the compression sleeve 230 in place within the connector body 210. At least one of the raised surfaces may fit within a corresponding groove or recess in order to hold the compression sleeve 230 in place within the connector body 210 so that the connector 200 may readily be maintained as a single piece unit until such time as a coaxial cable 10 is to be attached to the connector 200. The mating raised surfaces/recesses may be designed to only apply a small retention force so that the compression sleeve 230 may be readily moved from its unseated position of FIG. 10 into its seated position of FIG. 11 when terminating a coaxial cable 10 within the connector 200.

As shown in FIG. 11, the connector 200 may be used to terminate an end of a coaxial cable 10. Before the cable 10 is inserted into connector 200, end portions of the dielectric 14, the tape 16, the electrical shield 18 and the cable jacket 20 are cut off and removed so that the end portion of the central conductor 12 is fully exposed. Additional end portions of the cable jacket 20 and any electrical shielding tape are then removed to expose the end portion of the wires of the electrical shield 18, and the exposed wires of the electrical shield 18 are flared or folded back over the cable jacket 20. With reference to FIG. 11, it can be seen that the central conductor 12, dielectric 14, the tape 16 of cable 10 are axially inserted through the compression sleeve 230 and into the internal cavity 256 of the contact post 250, while the electrical shield 18 and the cable jacket 20 are inserted through the compression sleeve 230 and over the outside surface of the contact post 250. The exposed length of the central conductor 12 is sufficient such that it will extend all the way through the connector body 210 and into the internally-threaded nut 270 as the male contact protrusion of the connector 200. The exposed end portion of the wires of the electrical shield 18 reside in a bottom portion of the generally annular cavity between the contact post 250 and the connector body 210, and are in mechanical contact with at least one of the connector body 210 or the contact post 250, and make electrical contact with both the connector body 210 and the contact post 250.

Figure 2:
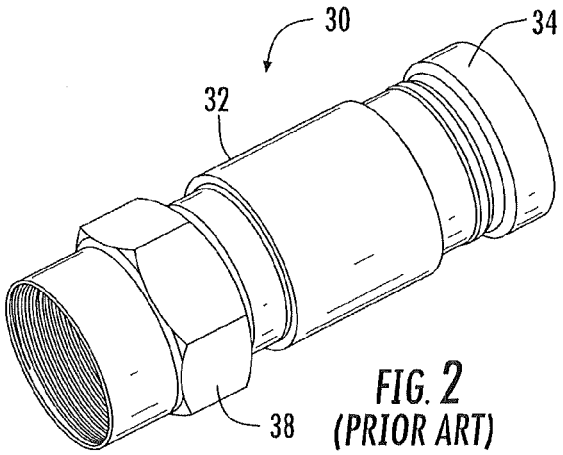
FIG. 2 (PRIOR ART)
FIG. 2 is a perspective view of a conventional male F-style coaxial connector that has a compression style back fitting with the compression sleeve in an unseated position.
Figure 4:
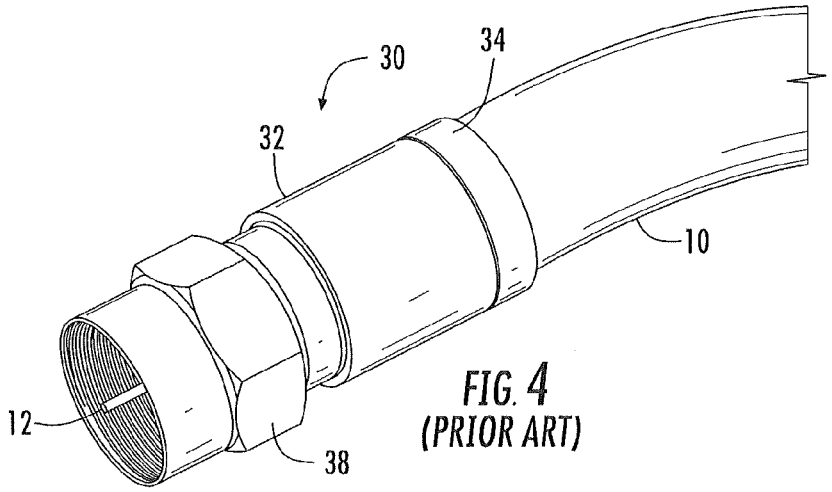
FIG. 4 (PRIOR ART)
FIG. 4 is a perspective view of the conventional F-style coaxial connector of FIG. 2 mounted on a coaxial cable to form a coaxial patch cord.

As discussed above, proper operation of the coaxial connector 200 typically requires that a reliable electrical connection be established between the conductive housing pieces of the connector 200 (e.g., the contact post 250, connector body 210 and/or internally-threaded nut 270) and the conductive housing 41 of the female connector port 40. This electrical connection is used to carry the ground plane from the electrical shield 18 of the coaxial cable 10 to the conductive housing 41 of the female connector port 40 (i.e., as a ground plane conduction path). With a conventional male F-style coaxial connector such as connector 30 of FIGS. 2-4 above, this typically is accomplished by tightly threading the internally-threaded nut 38 onto the female connector port 40 so as to bring a front face of the pedestal 36' of the contact post 36 into firm mechanical and electrical contact with the distal face 44 of the housing 41 of female connector port 40. The internally-threaded nut 38 is also in direct contact with the housing 41 of female connector port 40, and thus may also provide a secondary ground plane conduction path. However, this connection is a threaded connection, and in practice may not provide a high quality, reliable electrical connection for the ground path, particularly if the threaded connection has loosened to some degree. Consequently, if the connector 200 starts to unthread from the female connector port 40 sufficiently such that a reliable connection is lost between the front face of the pedestal 36' of the contact post 36 and the distal face 44 of the housing 41 of female connector port 40, then the ground plane conduction path may no longer have a reliable electrical connection, and the quality of the received signal may be degraded or even lost.

As shown in FIGS. 8-13, the connector 200 further includes the ground plane extension 100 of FIG. 7 mounted so as to extend into the female connector port receiving cavity 274 of the internally-threaded nut 270. The ground plane extension 100 is mounted in the connector 200 by inserting the distal end of the post of contact post 250 through the aperture 112 in the attachment ring 110 of ground plane extension 100. As the pedestal 252 of contact post 250 is wider than the aperture 112, the attachment ring 110 of ground plane extension 100 comes to rest against the rear face 252*b* of the pedestal 252 of contact post 250, and the sidewall 120 of the ground plane extension 100 extends into the female connector port receiving cavity 274 of nut 270.

The connector 200 may be assembled, for example, by inserting the front end of connector body 210 into the end of the nut 270 that is opposite the lip 272. Then, the post 254 of contact post 250 (with the ground plane extension 100 mounted thereon) is inserted into the end of the nut 270 that includes lip 272. As the contact post 250 is inserted, the distal end of post 254 may fit cleanly through the opening in the front end of the connector body 210. As it is inserted further, eventually a ramped transition portion 257 of the contact post 250 contacts the front end of the connector body 210. This ramped transition portion 257 has a larger external diameter, and hence it pushes against the interior of the connector body 210, thereby enlarging the opening in the connector body 210 as the contact post 250 is inserted further therein. Eventually, the entirety of the ramped transition portion 257 slides within the opening in the front end of the connector body 210, and the portion of the post 254 that is immediately adjacent the pedestal 252 (with the ground plane extension 100 mounted thereon) is fully received within the opening in the connector body 210. The external diameter of the base of the contact post 250 (i.e., the portion of the contact post between the pedestal 252 and the ramped transition section 257) exceeds the internal diameter of the opening in the connector body 210, and hence the base of the contact post 250 expands the opening in the connector body 210, thereby press-fitting the contact post 250 within the connector body 210. The pedestal 252 of the contact post 250 has an external diameter that exceeds the internal diameter of the annular ridge 278 that is provided in the interior of nut 270. Thus, the contact post 250 will rest within nut 270 such that the attachment ring 110 of ground plane extension 100 is locked between the rear face 252*b* of the pedestal 252 of the contact post 250 and the annular ridge 278 in the interior of nut 270. The cylindrical sidewall 120 of ground plane extension 100 extends into the female connector port receiving cavity 274 of the internally-threaded nut 270.

The internally-threaded nut 270 of connector 200 may be threaded onto a female connector port 40 as discussed above, for example, with respect to FIG. 6 When the internally-threaded nut 270 is fully and firmly tightened onto the female connector port 40, the distal face 44 of the housing 41 directly contacts the front face 252*a* of the pedestal 252 of the contact post 250, thereby providing an electrical connection between the contact post 250 and the housing 41 of female connector port 40 that serves as the primary ground plane conduction path.

FIG. 12 is a cross-sectional view of a portion of the connector 200 after it has been firmly threaded onto a female connector port 40. As is shown in FIG. 12, the housing 41 of the female connector port 40 flattens the inwardly extending region 128 of the distal portion 124 of the ground plane extension 100 against the interior of the nut 270. In some embodiments, the ground plane extension 100 may be fabricated from a resilient metal, and the resiliency of the inwardly extending region 128 of the distal portion 124 may facilitate maintaining a good mechanical and electrical connection between the sidewall 120 of ground plane extension 100 and the housing 41, as the resiliency of the flattened metal that forms the sidewall 120 creates a contact force between the sidewall 120 and both the nut 270 and the housing 41 of connector port 40. When the internally-threaded nut 270 is removed from connector port 40, the resilient sidewall 120 may return to its normal shape with the inwardly extending region 128. Thus, it can be seen from FIG. 12 that the ground plane extension 100 provides a secondary ground plane conduction path between the contact post 250 and the housing 41 of female connector port 40.

FIG. 13 is a cross-sectional view of portions of connector 200 and female connector port 40 after the threaded connection has loosened to a degree as might occur during normal use or because the connection was never properly tightened in the first place. As shown in FIG. 13, when the connector becomes loosened, the distal face 44 of the housing 41 separates from the front face 252*a* of the pedestal 252 of the contact post 250, thereby severing the primary ground plane conduction path between the contact post 250 and the female connector port 40. In addition, it can also be seen in FIG. 13 that when the internally-threaded nut 270 has loosened on the female connector port 40, the threads 276 of nut 270 may no longer firmly engage the threads 42 of connector port 40, and hence the electrical connection between the nut 270 and the female connector port 40 through the threads 276, 42 may provide a poor and/or unreliable connection. However, as shown in FIG. 13, a reliable secondary ground plane conduction path is still provided between the contact post 250 and the housing 41 of female connector port 40 through the threads 42 and the inwardly extending region 128 of sidewall 120 of the ground plane extension 100. Thus, FIG. 13 illustrates how the ground plane extensions according to embodiments of the present invention may maintain a ground plane conduction path even if the connector 200 becomes loosened on the connector port 40.

As also mentioned above, the ground plane extensions according to embodiments of the present invention may also provide coaxial connectors that are more resistant to loosening. Typically, when an F-style coaxial connector is tightened by hand onto a female connector port, the installer will apply a force of approximately 1-4 inch/lbs. to the rotatable nut on the coaxial connector. Such a force, however, may be insufficient to prevent the coaxial connector from being loosened when subjected to forces that may be applied during normal operation. In order to prevent such loosening, it has been recommended that a force of 20-40 inches/lb. be applied to an F-style coaxial connector when it is attached to a female coaxial cable port. However, the female connector ports on televisions, cable modems and other consumer electronic devices may not always be rated to withstand such forces, and thus there is a reluctance to tighten the F-style coaxial connector using forces of 20-40 inches/lb. for fear that an expensive electronic component may be damaged if the female connector port on the equipment cannot withstand such a force.

Pursuant to further embodiments of the present invention, coaxial connectors are provided that include an increased mechanical resistance element that is mounted on the pedestal of the contact post that extends into the female connector port receiving cavity of the internally-threaded nut. In some embodiments, the increased mechanical resistance element may comprise one of the ground plane extensions according to embodiments of the present invention. Thus, it will be understood that the ground plane extensions according to embodiments of the present invention may increase the drag and mechanical resistance that is provided in the threaded connection between the internally-threaded nut of the male coaxial connector and a female connector port. In particular, as shown above, in some embodiments, the sidewall (or sidewalls) of the ground plane extension may press against the housing 41 of the female connector port 40. The contact between the ground plane extension 100 and the housing 41 may increase the mechanical resistance that may help prevent the male coaxial connector 200 from unthreading from the female connector port 40. Additionally, the distal end of the ground plane extension can be configured to be trapped between a thread 42 of the female connector port 40 and the last thread 276 of nut 270, which may also increase both the drag and mechanical resistance.

Figure 14:
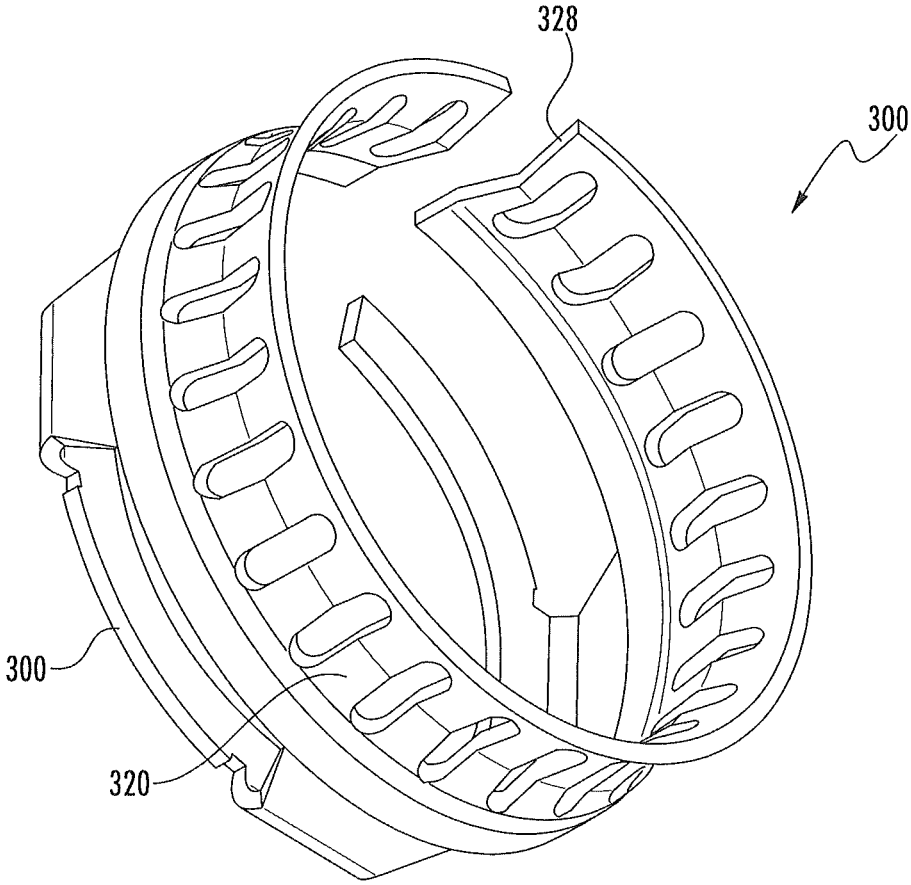
FIG. 14 is a perspective view of a ground plane extension according to further embodiments of the present invention.

FIG. 14 is a perspective view of a ground plane extension 300 according to further embodiments of the present invention. The ground plane extension 300 is similar to ground plane extension 100, having an attachment ring 310 that may be identical to the attachment ring 110, and a cylindrical sidewall 320. However, the sidewall 320 of ground plane extension 300 differs in that it includes an inwardly extending region 328 that is V-shaped as opposed to the concave-shaped inwardly extending region 128 of ground plane extension 100. The ground plane extension 300 may be used in place of ground plane extension 100 in coaxial connector 200, or on a wide variety of other F-style coaxial connectors.

Figure 15:
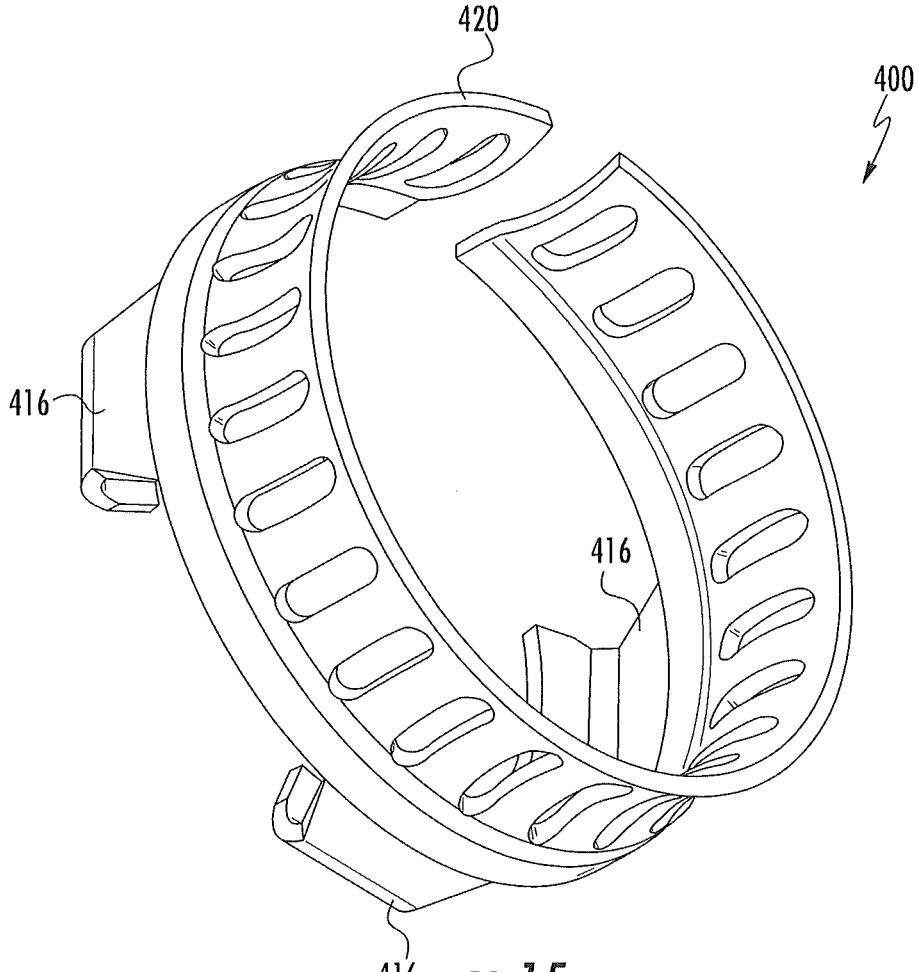
FIG. 15 is a perspective view of a ground plane extension according to still further embodiments of the present invention.

FIG. 15 is a perspective view of a ground plane extension 400 according to still further embodiments of the present invention. The ground plane extension 400 is similar to ground plane extension 100, having a sidewall 420 that may be identical to the sidewall 120. However, in the ground plane extension 400, the attachment ring 110 of ground plane extension 100 is omitted and instead the tabs 416 that connect to the sidewall 420 are extended so that a distal end of each tab 416 extends around to the back side 252*b* of the pedestal 252. In the embodiment shown, the ground plane extension 400 includes three tabs 416. It will be appreciated that more or fewer tabs 416 may be provided in other embodiments. The ground plane extension 400 may be used in place of ground plane extension 100 in coaxial connector 200, or on a wide variety of other F-style coaxial connectors.

Figure 16:
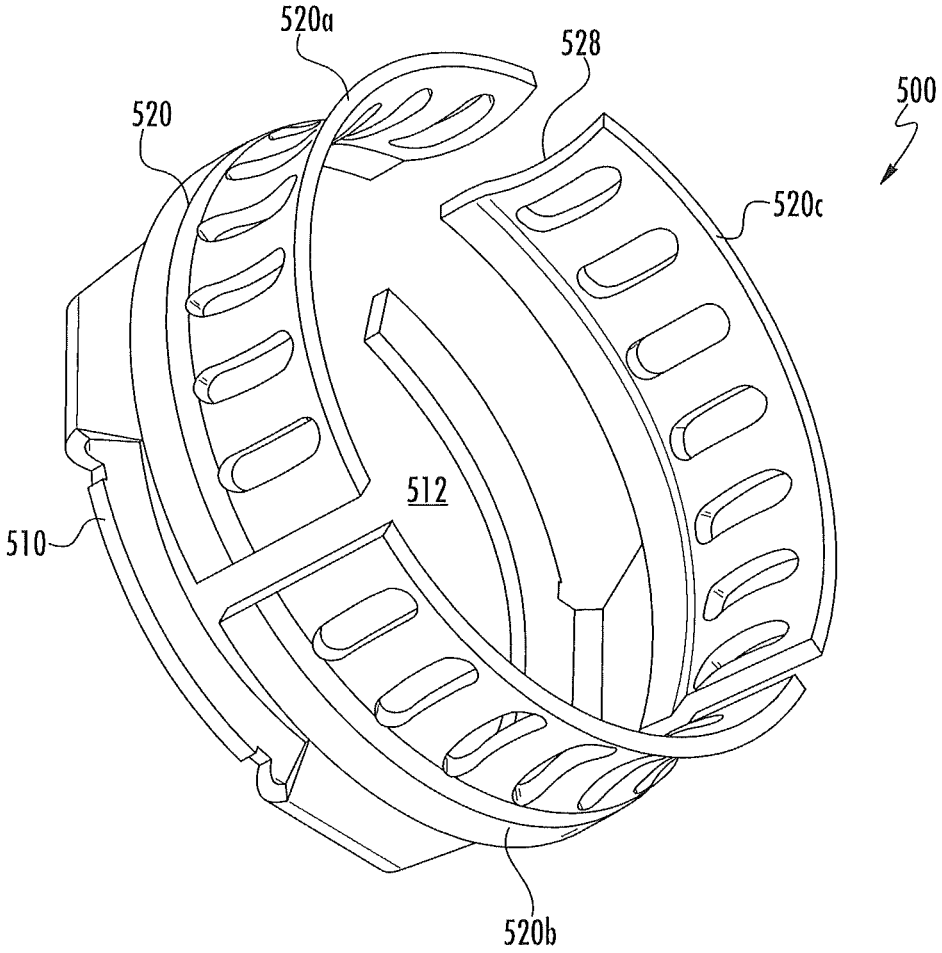
FIG. 16 is a perspective view of the ground plane extension according to yet additional embodiments of the present invention.

FIG. 16 is a perspective view of a ground plane extension 500 according to still further embodiments of the present invention. The ground plane extension 500 may be included in coaxial connectors according to embodiments of the present invention such as, for example, the coaxial connector 600 that is described below with respect to FIGS. 17-19.

Referring to FIG. 16, the ground plane extension 500 includes an attachment ring 510 and a generally cylindrical sidewall 520. The attachment ring 510 includes an aperture 512 that may be sized to receive, for example, the post of the contact post of the coaxial connector 600. The distal portion 524 of sidewall 520 includes an inwardly extending region 528. The ground plane extension 500 may be formed, for example, of a resilient conductive metal such as phosphor-bronze or beryllium-copper. The ground plane extension 500 differs from the ground plane extension 100 discussed above in that the sidewall 520 includes a plurality of slits 532 that divide the sidewall 520 into multiple sidewall pieces 520*a*, 520*b*, 520*c*. As discussed in more detail below, dividing the sidewall 520 into multiple pieces may facilitate assembly of a connector that includes the ground plane extension 500.

Figure 17:
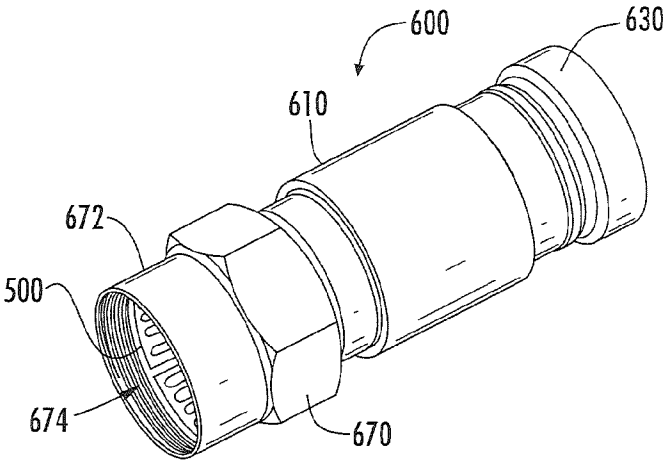
FIG. 17 is a perspective view of a coaxial connector according to further embodiments of the present invention that includes the ground plane extension of FIG. 16.
Figure 18:
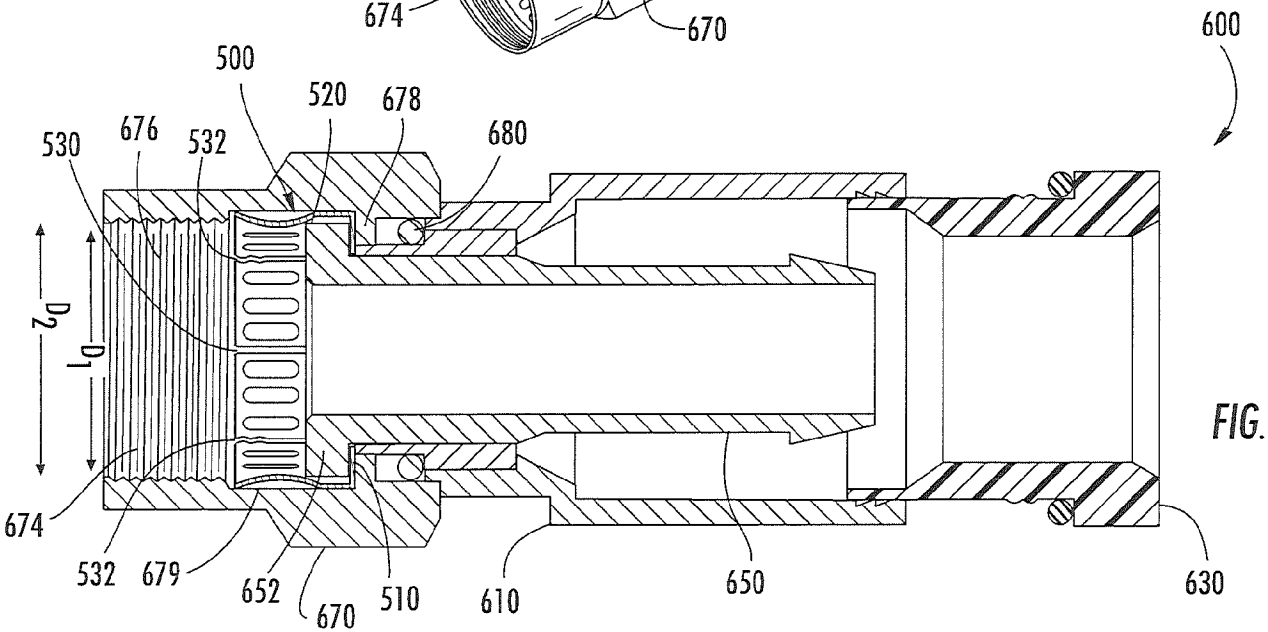
FIG. 18 is a cross-sectional view of the coaxial connector of FIG. 17.
Figure 19:
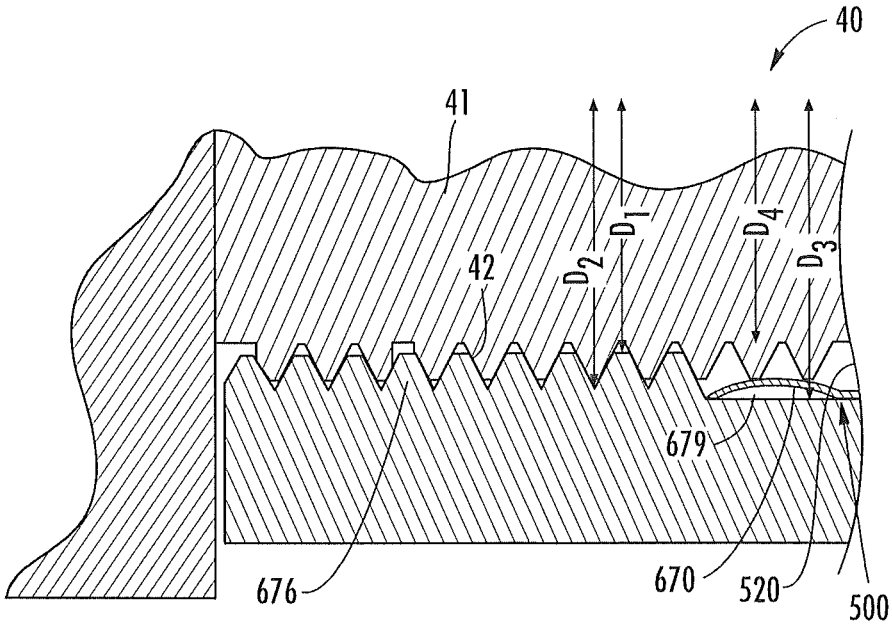
FIG. 19 is a cross-sectional view of a portion of the connector of FIG. 17 after the connector has been firmly threaded onto a female connector port.

FIGS. 17-19 illustrate a coaxial connector 600 according to embodiments of the present invention that includes the ground plane extension 500 of FIG. 16. In particular, FIG. 17 is a perspective view of the coaxial connector 600, FIG. 18 is a cross-sectional view of the coaxial connector 600, and FIG. 19 is a cross-sectional view of a small portion of the connector 600 after it has been firmly threaded onto a mating female connector port 40.

Referring to FIGS. 17-19, it can be seen that the coaxial connector 600 includes a tubular connector body 610, a compression sleeve 630, a contact post 650, an internally-threaded rotatable nut 670 and the ground plane extension 500. The connector body 610, the compression sleeve 630, and the contact post 650 may, for example, be identical to the connector body 210, the compression sleeve 230, and the contact post 250 that are discussed above with respect to FIGS. 8-13. Accordingly, further description of these components will be omitted.

The internally-threaded nut 670 may comprise, for example, a conductive or insulative nut having an exterior surface that has a hexagonal cross-section in a direction normal to the longitudinal direction, and may include a lip 672. The nut 670 is mounted adjacent a front end of the connector body 610 so that it may freely rotate with respect to the connector body 610. The internally-threaded nut 670 includes a female connector port receiving cavity 674 that includes a plurality of threads 676 in a front portion thereof. The peaks of the threads 676 define a first internal diameter $D_1$ and the valleys of the threads 676 define a second internal diameter $D_2$. The nut 670 further includes an internal annular ridge 678. A recessed area 679 that has a third internal diameter $D_3$ that is larger than at least the first internal diameter $D_1$ and, in some embodiments, the second internal diameter $D_2$, is provided between the internal annular ridge 678 and the threads 676. The recessed area 679 is not threaded. An O-ring, gasket or other member 680 may be positioned between the internally-threaded nut 670 and the connector body 610.

As shown in FIG. 18, the sidewall 520 of the ground plane extension 500 may fit within the recessed area 679. As is also apparent from FIG. 18, the maximum diameter of the generally cylindrical sidewall 520 may exceed the internal diameter $D_1$ defined by the peaks of the threads 676 (in some embodiments, it may also exceed the internal diameter $D_2$ defined by the valleys of the threads 676). In order to assemble the connector 600, the ground plane extension 500 may be squeezed so that the sidewall pieces 520*a*, 520*b*, 520*c* are pressed together in order to reduce the diameter of the sidewall 520 to a diameter that is smaller than diameter $D_1$, thereby allowing the ground plane extension 500 to be inserted into the female connector port receiving cavity 674 of nut 670 and into the recessed area 679. The slits 532 facilitate squeezing the sidewall pieces 520*a*, 520*b*, 520*c* together. When the ground plane extension 500 is received within the recessed area 679, it may spring back open as is shown in FIG. 18. Thus, the slits 532 in the sidewall 520 allows the ground plane extension 500 to be received within the recessed area 679.

The connector 600 may be assembled, for example, in the same manner that connector 200 is assembled. However, in some embodiments, the ground plane extension 500 may be inserted into the internally-threaded nut 670 before the contact post 650 is inserted into the nut 670.

The internally-threaded nut 670 of connector 600 may be threaded onto a female connector port 40. When the internally-threaded nut 670 is fully and firmly tightened onto the female connector port 40, the distal face 44 of the housing 41 directly contacts the front face of the pedestal 652 of the contact post 650, thereby providing an electrical connection between the contact post 650 and the housing 41 of female connector port 40 that serves as the primary ground plane conduction path.

FIG. 19 is a cross-sectional view of a portion of the nut 670 and ground plane extension 500 of connector 600 after the connector 600 has been firmly threaded onto a female connector port 40. As is shown in FIG. 19, the sidewall 520 of the ground plane extension 500 is fully received within the recessed area 679, and does not overlap the threads 676. The inwardly extending region 528 in sidewall 520 of ground plane extension 500 may have a minimum diameter $D_4$ that is less than the diameter $D_1$ defined by the peaks of the threads 676. However, the threads 42 of the female connector port 40 press the inwardly extending region 528 outwardly such that the minimum diameter of the sidewall 520 is increased. As a result of this outward force, the inwardly extending region 528 of the sidewall 520 is maintained in firm contact with the sides of the cylindrical housing 41 of female connector port 40 when female connector port 40 is received within the female connector port receiving cavity 674 of nut 670. This facilitates maintaining a good mechanical and electrical connection between the sidewall 520 of ground plane extension 500 and the housing 41, as the housing 41 partially flattens the sidewall 520, and the resiliency of the flattened metal that forms the sidewall 520 creates a contact force between the sidewall 520 and both the nut 670 and the housing 41 of connector port 40. Thus, the ground plane extension 500 provides a secondary ground plane conduction path between the contact post 650 and the housing 41 of female connector port 40. It will be appreciated that all of the ground pane extensions disclosed herein may be appropriately sized for use in the connector 600 and arranged such that they do not overlap the threads 676 of connector 600. Connector designs such as connector 600 where the ground plane extension does not overlap the threads of the internally-threaded nut of the connector may exhibit high reliability as the ground plane extension does not interact with either the threads 676 of the nut 670, and hence is less susceptible to damage, deformation, seizing or the like.

Figure 20:
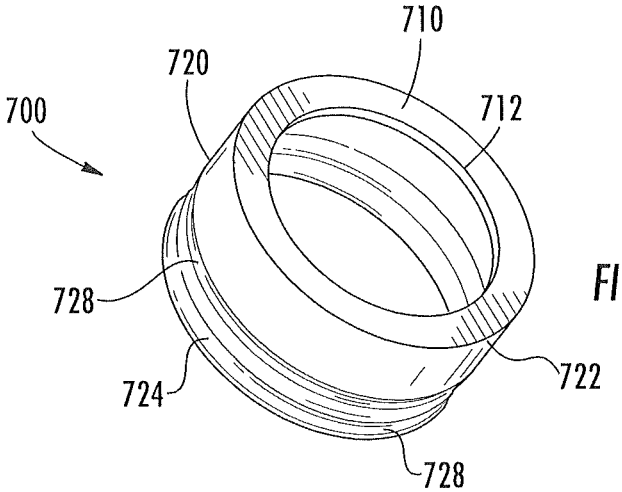
FIG. 20 is a perspective view of a ground plane extension according to still further embodiments of the present invention.

FIG. 20 is a perspective view of a ground plane extension 700 according to still further embodiments of the present invention. The ground plane extension 700 may be formed of any suitable conductive material, specifically including a resilient metal such as, for example, phosphor-bronze or beryllium-copper. As shown in FIG. 20, the ground plane extension 700 includes an attachment ring 710 that may be used to mount the ground plane extension 700 onto the contact post of a male coaxial connector. The attachment ring 710 defines an aperture 712 that may be sized to receive, for example, the post of the contact post of the coaxial connector in which the ground plane extension 700 is used. The ground plane extension 700 further includes a generally cylindrical sidewall 720. A base 722 of the sidewall 720 connects to the attachment ring 710. The ground plane extension 700 generally has a cup shape, with the aperture 712 defining a large hole in the bottom of the cup. A distal portion 724 of the sidewall 720 includes one or more internal ridges 728 where the distal portion of the sidewall juts farther inwardly than a base portion of the sidewall 720. In the depicted embodiment, two such ridges 728 are provided. These ridges 728 may be configured to make mechanical and electrical contact with the cylindrical housing 41 of a female connector port 40 when the ground plane extension 700 is used in a male coaxial connector that is mounted on the female connector port 40. These internal ridges 728 may deflect outwardly when contacted by the housing 41 of a female connector port, and the resiliency of the metal used to form the ground plane extension may facilitate providing a good mechanical and electrical contact between the ground plane extension 700 and the female connector port 40.

Figure 21:
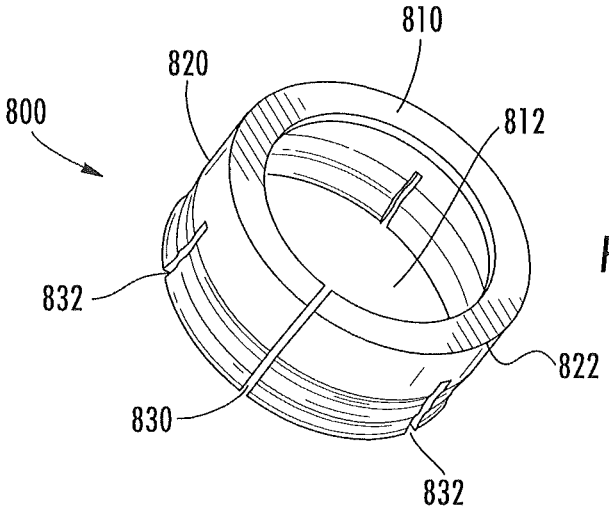
FIG. 21 is a perspective view of a ground plane extension according to additional embodiments of the present invention.

FIG. 21 is a perspective view of a ground plane extension 800 according to still further embodiments of the present invention. The ground plane extension 800 may be formed of any suitable conductive material, specifically including a resilient metal such as, for example, phosphor-bronze or beryllium-copper. As shown in FIG. 21, the ground plane extension 800 includes an attachment ring 810 that may be used to mount the ground plane extension 800 onto the contact post of a male coaxial connector. The attachment ring 810 defines an aperture 812 that may be sized to receive, for example, the post of the contact post of the coaxial connector in which the ground plane extension 800 is used. The ground plane extension 800 further includes a generally cylindrical sidewall 820. A base 822 of the sidewall 820 connects to the attachment ring 810. The ground plane extension 800 is similar to the ground plane extension 700 of FIG. 20, and hence like features of the ground plane extension 800 will not be discussed herein in the interest of brevity.

The ground plane extension 800 differs from the ground plane extension 700 in that it includes a longitudinal slot 830 that bisects the entire length of sidewall 820 and also bisects the attachment ring 810. This slot 830 may facilitate assembly of a connector that includes the ground plane extension 800 in the same manner that the slits 532 facilitate assembly of a connector that includes the ground plane extension 500, as is discussed above. The ground plane extension 800 may further include a plurality of slits 832. In some embodiments, three or five slits 832 may be provided, and each of the slots/slits 830, 832 may be spaced at approximately equidistant around the periphery of the sidewall 820. For example, in an embodiment that includes five slits 832, each slot/slit 830, 832 may be spaced approximately sixty degrees apart around sidewall 820 from its adjacent slots/slits 830, 832.

Figure 22:
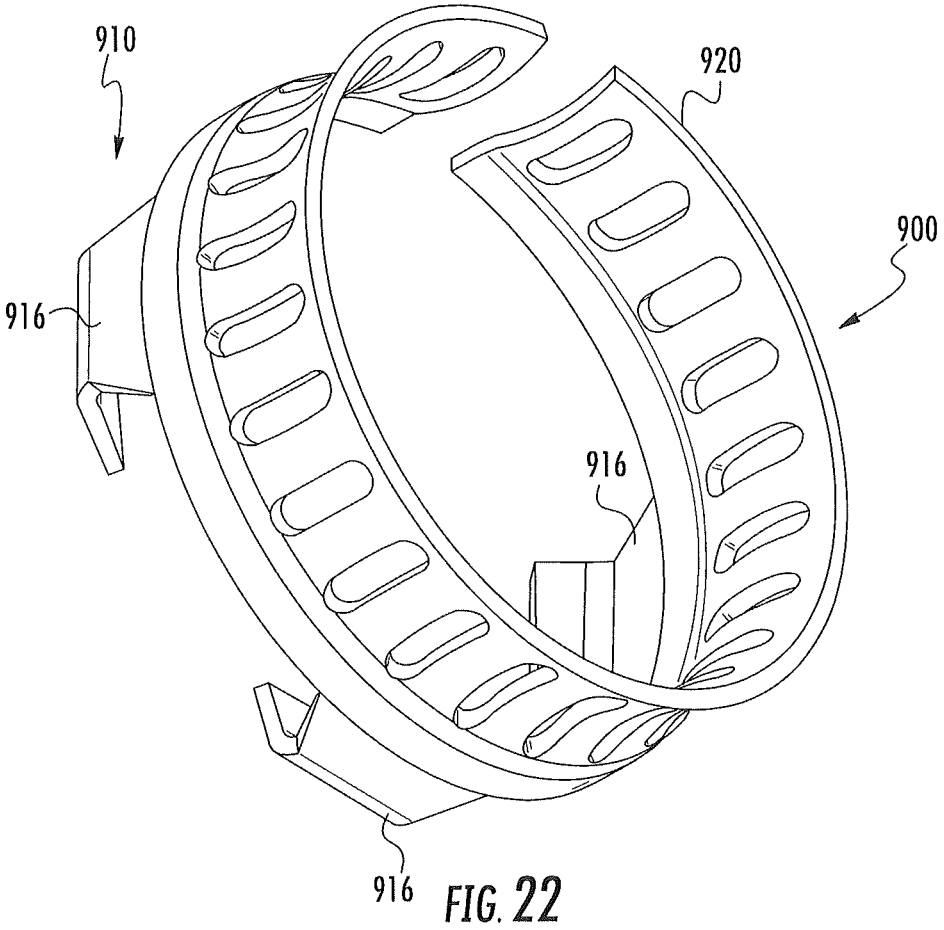
FIG. 22 is a perspective view of a ground plane extension according to still further embodiments of the present invention.

FIG. 22 is a perspective view of a ground plane extension 900 according to still further embodiments of the present invention. The ground plane extension 900 may be formed of a resilient metal such as, for example, phosphor-bronze or beryllium-copper. As shown in FIG. 22, the ground plane extension 900 includes three tabs 916 that define an attachment ring 910 that may be used to mount the ground plane extension 900 onto the contact post of a male coaxial connector. The ground plane extension 900 further includes a generally cylindrical sidewall 920 that may be identical to the sidewall 120 of the ground plane extension 100 that is discussed above with reference to FIG. 7, and hence the sidewall 920 will not be discussed further herein. The ground plane extension 900 differs from the ground plane extension 100 in that the tabs 916 and the sidewall 920 define an acute angle as opposed to a ninety degree angle. When a coaxial connector that includes the ground plane extension 900 is mounted on a female connector port, the back side of the pedestal of the contact post is forced tightly against the internal annular ridge of the nut, as can be seen, for example, from FIG. 18. When this occurs, the tabs 916 are bent so that each tab is at approximately a ninety degree angle with respect to the sidewall 920. Thereafter, if the nut of the coaxial connector loosens from the female connector port, the back side of the pedestal of the contact post may move slightly away from the internal annular ridge of the nut. When this occurs, the tabs 916 may start to resiliently deflect back to their normal resting position. As a result of this resiliency, the tabs 916 may stay tightly pressed against both the back side of the pedestal of the contact post and the internal annular ridge of the nut, and therefore, the tabs 916 may stay in good mechanical and electrical contact with the contact post. Thus, by forming the tabs 916 so that they will act as resilient springs, the ground plane extension may also maintain a good electrical connection to the contact post even as the nut loosens from the female connector port. It will be appreciated that the attachment ring and/or tabs of any of the ground plane extensions according to embodiments of the present invention that are disclosed herein may be modified to have such a spring feature. It will also be appreciated that a variety of different spring designs may be used.

The ground plane extensions according to embodiments of the present invention provide a direct electrical path from the contact post to the housing of the female connector port. As such, they may be used on male coaxial connectors in which either or both the internally-threaded nut and/or the connector body of the coaxial connector are formed of an insulative material such as plastic. With conventional connectors, the use of either an insulative connector body or nut would typically eliminate the secondary ground plane conduction path discussed above. Since a third ground plane conduction path may be provided in the coaxial connectors according to embodiments of the present invention through the ground plane extension, the disadvantages associated with the use of insulative connector bodies and/or internally-threaded nuts may be mitigated.

The ground plane extensions according to embodiments of the present invention may improve the performance of a coaxial connector. For example, the ground plane extension may maintain a reliable ground plane conduction path between the contact post and a female connector port on which the male coaxial F connector is mounted even if the male coaxial connector is not fully threaded onto the female connector port. In some embodiments, the ground plane extensions may maintain a reliable ground plane conduction path even if the male coaxial connector is unthreaded by as much as, for example, 3 full rotations. Additionally, the ground plane extensions according to some embodiments of the present invention may provide increased drag and mechanical resistance between the internally-threaded nut of the male coaxial connector and the threaded housing of the female connector port on which it is mounted. This increased drag and mechanical resistance may help the male coaxial connector resist unthreading. It will be appreciated, however, that some embodiments may only provide some of the above-listed advantages, and that the ground plane extensions according to embodiments of the present invention may also provide additional advantages (e.g., providing a good ground plane conduction path while allowing for a connector design that includes an internally-threaded nut that freely rotates with respect to the connector body).

It will be appreciated that the ground plane extensions according to embodiments of the present invention that are described and pictured above may be used on any F-style coaxial connector, and that the invention is not limited to the particular F-style coaxial connector depicted in FIGS. 8-13 and 17-19 above. By way of example, the ground plane extensions according to embodiments of the present invention may be used on F-style coaxial connectors that have a compression sleeve that fits over the outside surface of the connector body and/or on F-style coaxial connectors that use crimped or swaged compression elements. Coaxial connectors that include the ground plane extensions according to embodiments of the present invention may be used in both indoor and outdoor applications.

It will be appreciated that many modifications may be made to the exemplary embodiments of the present invention described above without departing from the scope of the present invention. For example, the ground plane extensions may have different attachment mechanisms for mounting on a pedestal of the contact post and/or different sidewall configurations. In some embodiments, the ground plane extension may be mounted differently such as, for example, mounted on the connector body instead of the contact post. Thus, it will be appreciated that while exemplary embodiments have been described and shown above, the claims appended hereto define the scope of the present invention.

It will further be appreciated that the features and components of the various embodiments described above may be further mixed and matched to provide yet additional embodiments of the present invention. It will likewise be appreciated that multiple components of the ground plane extensions and/or coaxial connectors described above may be combined into a single piece and/or that some of the components may be implemented as multi-part components.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A coaxial connector, comprising a conductive contact post that has a pedestal and a post extending from the pedestal;

a ground plane extension that is separate from the contact post, the ground plane extension including a first end that is positioned on a first side of the pedestal of the contact post and a sidewall extending from the first end, the sidewall extending beyond a second side of the pedestal of the contact post that is opposite the first side a connector body having an internal cavity; and an internally-threaded nut that includes a female connector port receiving cavity, the internally-threaded nut attached to at least one of the connector body and the contact post, wherein the contact post is at least partly within the internal cavity of the connector body.

2. The coaxial connector of claim 1, wherein the first end of the ground plane extension comprises an attachment ring that defines an aperture that receives the post member of the contact post.

3. The coaxial connector of claim 2, wherein the second end of the ground plane extension comprises one or more sidewalls that define a generally cylindrical sidewall.

4. The coaxial connector of claim 3, wherein the generally cylindrical sidewall includes an inwardly extending region.

5. The coaxial connector of claim 1, wherein the internally-threaded nut is formed of an insulative material.

6. The coaxial connector of claim 1 mounted on a coaxial cable to provide a coaxial patch cord.

7. A coaxial connector, comprising a conductive contact post that has a pedestal and a post extending from the pedestal;

a ground plane extension that is separate from the contact post, the ground plane extension including a first end that is positioned on a first side of the pedestal of the contact post and a sidewall extending from the first end, the sidewall extending beyond a second side of the pedestal of the contact post that is opposite the first side; and an internally-threaded nut that includes a female connector port receiving cavity, wherein the sidewall of the ground plane extension extends into the female connector port receiving cavity.

8. The coaxial connector of claim 3, wherein at least a portion of the generally cylindrical sidewall is configured to fit directly between a housing of a female connector port and an internal diameter of the female connector port receiving cavity of the internally-threaded nut when the female connector port is received within the female connector port receiving cavity of the internally-threaded nut.

9. The coaxial connector of claim 3, wherein the generally cylindrical sidewall includes at least one longitudinal slit.

10. The coaxial connector of claim 2, wherein the attachment ring comprises a spring member that is positioned between the pedestal of the contact post and an internal annular ridge of the internally-threaded nut.

11. A coaxial connector, comprising:

a connector body;

a contact post that includes a pedestal and a post extending from the pedestal, the contact post being positioned at least partly within the connector body;

an internally-threaded nut that includes a female connector port receiving cavity, the internally-threaded nut attached to at least one of the connector body and the contact post; and a ground plane extension that is electrically connected to the contact post, the ground plane extension including a first spring that is configured to contact a female connector port that is received within the female connector port receiving cavity of the internally-threaded nut and a second spring that is configured to contact the contact post.

12. The coaxial connector of claim 11, wherein the ground plane extension includes a sidewall that has an inwardly extending region that forms at least part of the first spring.

13. The coaxial connector of claim 11, wherein a portion of the female connector port receiving cavity of the internally-threaded nut that is adjacent to the pedestal of the contact post does not include any threads.

14. The coaxial connector of claim 7, wherein at least part of the ground plane extension is formed of a resilient metal.

15. The coaxial connector of claim 7, wherein the first end comprises an attachment ring, and wherein the attachment ring and the sidewall are formed of a resilient conductive material.

16. The coaxial connector of claim 7, wherein a portion of the female connector port receiving cavity of the internally-threaded nut that is adjacent the pedestal of the contact post does not include any threads.

17. A coaxial connector, comprising:

a connector body;

a contact post that includes a pedestal and a post extending from the pedestal, the contact post being positioned at least partly within the connector body;

an internally-threaded nut that includes a female connector port receiving cavity, the internally-threaded nut attached to at least one of the connector body and the contact post; and a ground plane extension that is electrically connected to the contact post, the ground plane extension being positioned at least partly within the female connector port receiving cavity of the internally-threaded nut, wherein the internally-threaded nut is formed of an insulative material.

18. The coaxial connector of claim 15, wherein the attachment ring defines an aperture that is configured to receive the post of the contact post therethrough.

19. The coaxial connector of claim 17, wherein the conductive ground plane extension comprises a conductive element having an attachment ring and at least one sidewall, the attachment ring including an aperture that receives the post of the contact post and the sidewall extending into the female connector port receiving cavity of the internally-threaded nut.

20. The coaxial connector of claim 19, wherein at least part of the ground plane extension is formed of a resilient metal.

21. The coaxial connector of claim 17, wherein the ground plane extension is formed of a resilient conductive material.

22. The coaxial connector of claim 17, wherein the ground plane extension includes a generally cylindrical sidewall that includes at least one slit.

23. The coaxial connector of claim 17, wherein the ground plane extension includes a generally cylindrical sidewall, at least a portion of which is configured to fit directly between a housing of a female connector port and an internal diameter of the female connector port receiving cavity of the internally-threaded nut when the female connector port is received within the female connector port receiving cavity of the internally-threaded nut.

24. The coaxial connector of claim 17, wherein a portion of the female connector port receiving cavity of the internally-threaded nut that is adjacent the pedestal of the contact post does not include any threads.

* * * * *